US009506344B2

(12) United States Patent
Harrison et al.

(10) Patent No.: US 9,506,344 B2
(45) Date of Patent: Nov. 29, 2016

(54) TUNNELING APPARATUS

(75) Inventors: Stuart Harrison, Clyde (AU); Edwin Spoelstra, Leighton, IA (US); Nathan James Meyer, Knoxville, IA (US)

(73) Assignee: Vermeer Manufacturing Company, Pella, IA (US)

( * ) Notice: Subject to any disclaimer, the term of this patent is extended or adjusted under 35 U.S.C. 154(b) by 172 days.

(21) Appl. No.: 14/123,347

(22) PCT Filed: May 31, 2012

(86) PCT No.: PCT/US2012/040190

§ 371 (c)(1),
(2), (4) Date: Apr. 9, 2014

(87) PCT Pub. No.: WO2012/166905

PCT Pub. Date: Dec. 6, 2012

(65) Prior Publication Data

US 2014/0219725 A1 Aug. 7, 2014

Related U.S. Application Data

(60) Provisional application No. 61/492,241, filed on Jun. 1, 2011.

(51) Int. Cl.

| | |
|---|---|
| ***E21D 9/02*** | (2006.01) |
| ***E21D 9/10*** | (2006.01) |
| ***E21D 9/00*** | (2006.01) |
| ***E21B 7/04*** | (2006.01) |
| ***E21B 7/06*** | (2006.01) |

(52) U.S. Cl.

CPC ..... *E21D 9/1006* (2013.01); *E21B 7/046* (2013.01); *E21B 7/06* (2013.01); *E21B 7/067* (2013.01); *E21D 9/004* (2013.01); *E21D 9/02* (2013.01)

(58) Field of Classification Search

CPC ..... E21B 7/046; E21B 7/06; E21B 7/067; E21D 9/02

See application file for complete search history.

(56) References Cited

U.S. PATENT DOCUMENTS

| | | | | |
|---|---|---|---|---|
| 413,383 | A * | 10/1889 | Beecher | 405/137 |
| 3,190,374 | A * | 6/1965 | Jean Caperan et al. | 175/74 |
| 3,603,100 | A * | 9/1971 | Cowley | 405/138 |
| 3,857,449 | A | 12/1974 | Kimura | |
| 4,013,134 | A | 3/1977 | Richmond et al. | |
| 4,059,163 | A | 11/1977 | Stedman | |
| 4,818,026 | A | 4/1989 | Yamazaki et al. | |

(Continued)

FOREIGN PATENT DOCUMENTS

| | | |
|---|---|---|
| EP | 1 589 187 B1 | 3/2007 |
| WO | WO 96/30616 | 10/1996 |
| WO | WO 2007143773 A1 * | 12/2007 |

OTHER PUBLICATIONS

International Search Report for corresponding International Patent Application No. PCT/US2012/040190 mailed Jan. 17, 2013.

(Continued)

*Primary Examiner* — Tara M. Pinnock
(74) *Attorney, Agent, or Firm* — Merchant & Gould P.C.

(57) ABSTRACT

A tunneling apparatus includes a drill head and a steering shell. The drill head includes a main body having a distal end and an oppositely disposed proximal end. The steering shell is disposed at the distal end of the drill head and is movable relative to the main body of the drill head. The drill head includes structure that assists in maintaining a precise line.

23 Claims, 16 Drawing Sheets

(56) References Cited

U.S. PATENT DOCUMENTS

| | | | | |
|---|---|---|---|---|
| 5,135,326 | A * | 8/1992 | Mitani et al. | 405/143 |
| 5,186,579 | A * | 2/1993 | Hanamoto et al. | 405/143 |
| 5,484,029 | A | 1/1996 | Eddison | |
| 6,158,529 | A | 12/2000 | Dorel | |
| 6,585,062 | B2 * | 7/2003 | Rozendaal et al. | 175/53 |
| 8,151,906 | B2 | 4/2012 | Salins et al. | |
| 8,424,618 | B2 | 4/2013 | Harrison et al. | |
| 8,439,450 | B2 | 5/2013 | Harrison et al. | |
| 9,039,330 | B1 * | 5/2015 | Olson et al. | 405/184.5 |
| 2004/0108139 | A1 | 6/2004 | Davies | |
| 2010/0025115 | A1 * | 2/2010 | Kotsonis et al. | 175/61 |
| 2010/0230171 | A1 | 9/2010 | Harrison et al. | |

OTHER PUBLICATIONS

Supplementary European Search Report for Application No. 12793797.7 completed Jul. 3, 2015.

* cited by examiner

TUNNELING APPARATUS

This application is a National Stage Application of PCT/US2012/040190, filed May 31, 2012, which claims benefit of U.S. Provisional Patent Application Ser. No. 61/492,241, filed Jun. 1, 2011, and which applications are incorporated herein by reference. To the extent appropriate, a claim of priority is made to each of the above disclosed applications.

BACKGROUND

Modern installation techniques provide for the underground installation of services required for community infrastructure. Sewage, water, electricity, gas and telecommunication services are increasingly being placed underground for improved safety and to create more visually pleasing surroundings that are not cluttered with visible services.

One method for installing underground services involves excavating an open trench. However, this process is time consuming and is not practical in areas supporting existing construction. Other methods for installing underground services involve boring a horizontal underground hole. However, most underground drilling operations are relatively inaccurate and unsuitable for applications on grade and on line.

SUMMARY

An aspect of the present disclosure relates to a tunneling apparatus having features that enhance performance and the ability to maintain a precise line even in soft drilling conditions. In certain embodiments, stabilization wings can be provided on a drill head of the tunneling apparatus. In certain embodiments, the wings can be extended and retracted. In other embodiments, a pivotally movable steering shell can be used.

Another aspect of the present disclosure relates to a tunneling apparatus. The tunneling apparatus includes a drill head and a steering shell. The drill head includes a main body having a distal end and an oppositely disposed proximal end. The steering shell is disposed at the distal end of the drill head and is moveable relative to the main body of the drill head. The steering shell includes a body having an outer surface and a plurality of wings disposed on the outer surface.

A further aspect of the present disclosure relates to a tunneling apparatus. The tunneling apparatus includes a drill head and a steering shell. The drill head includes a main body and a cutter unit. The drill head defines a central longitudinal axis. The main body of the drill head includes a distal end and an oppositely disposed proximal end. The cutter unit is disposed on the distal end of the main body and is adapted to rotate about the central longitudinal axis. The steering shell is disposed at the distal end of the drill head and is moveable relative to the main body of the drill head. The steering shell includes a body having an outer surface and a plurality of wings disposed on the outer surface. Each of the wings has a leading end and a tail end. The wings extend farther outwardly in a radial direction than the cutter unit of the drill head.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
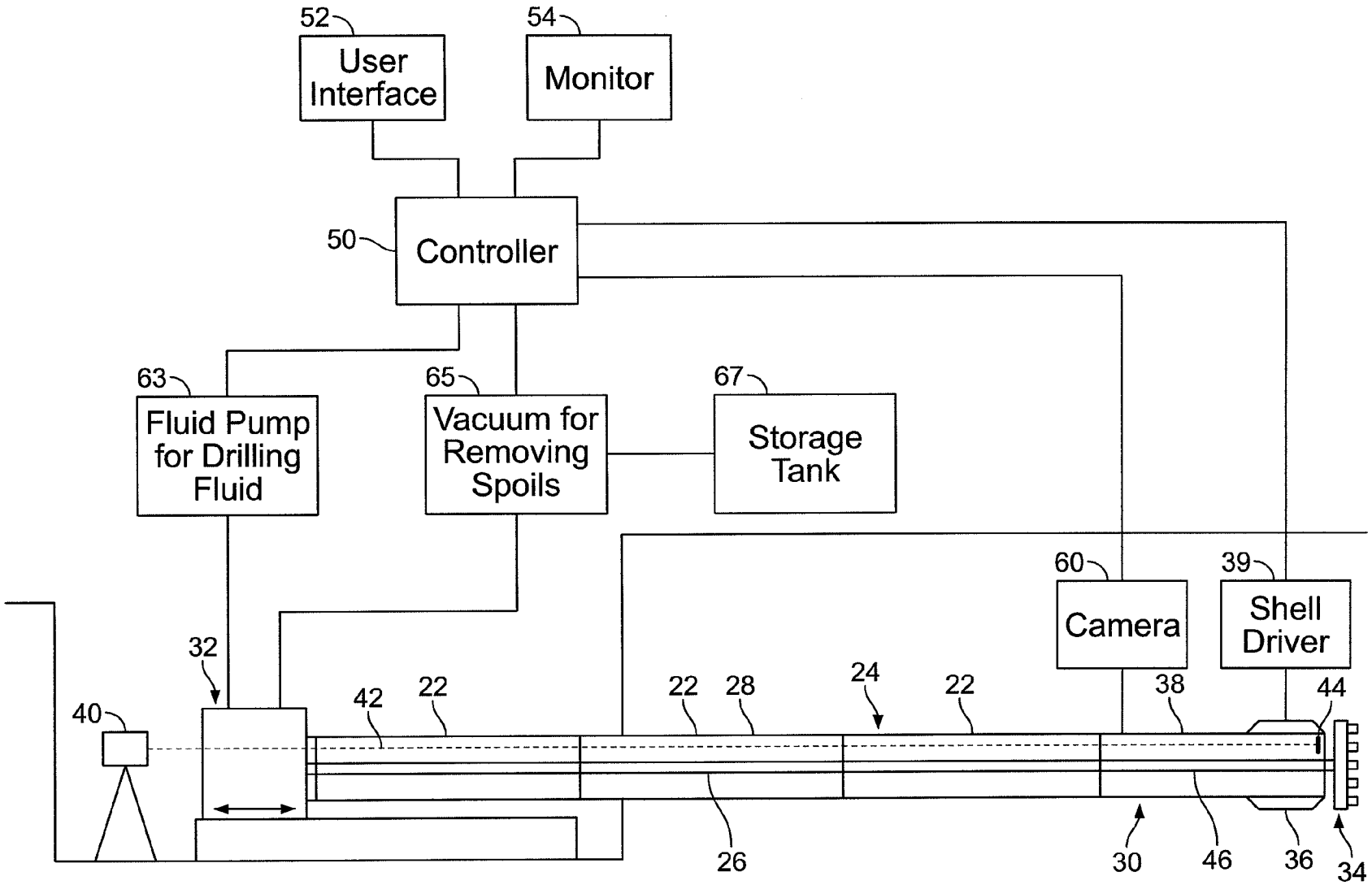
FIG. 1 is a schematic representation of a tunneling apparatus having exemplary features of aspects in accordance with the principles of the present disclosure.

Referring now to FIG. 1, a tunneling apparatus 20 is shown. The tunneling apparatus 20 includes a plurality of pipe sections 22 that are coupled together in an end-to-end relationship to form a drill string 24. Each of the pipe sections 22 includes a drive shaft 26 rotatably mounted in an outer casing assembly 28. A drill head 30 is mounted at a distal end of the drill string 24 while a drive unit 32 is located at a proximal end of the drill string 24. The drive unit 32 includes a torque driver adapted to apply torque to the drill string 24 and an axial driver for applying thrust or pull-back force to the drill string 24. Thrust or pull-back force from the drive unit 32 is transferred between the proximal end to the distal end of the drill string 24 by the outer casing assemblies 28 of the pipe sections 22. Torque is transferred from the proximal end of the drill string 24 to the distal end of the drill string 24 by the drive shafts 26 of the pipe sections 22 which rotate relative to the casing assemblies 28. The torque from the drive unit 32 is transferred through the apparatus 20 by the drive shafts 26 and ultimately is used to rotate a cutting unit 34 of the drill head 30.

The pipe sections 22 can also be referred to as drill rods, drill stems or drill members. The pipe sections are typically used to form an underground bore, and then are removed from the underground bore when product (e.g., piping) is installed in the bore.

The drill head 30 of the drilling apparatus 20 can include a drive stem 46 rotatably mounted within a main body 38 of the drill head 30. The main body 38 can include a one piece body, or can include multiple pieces or modules coupled together. A distal end of the drive stem 46 is configured to transfer torque to the cutting unit 34. A proximal end of the drive stem 46 couples to the drive shaft 26 of the distal-most pipe section 22 such that torque is transferred from the drive shafts 26 to the drive stem 46. In this way, the drive stem 46 functions as the last leg for transferring torque from the drive unit 32 to the cutting unit 34. The outer casing assemblies 28 transfer thrust and/or pull back force to the main body 38 of the drill head 30. The drill head 30 preferably includes bearings (e.g., axial/thrust bearings and radial bearings) that allow the drive stem 46 to rotate relative to the main body 38 and also allow thrust or pull-back force to be transferred from the main body 38 through the drive stem 46 to the cutting unit 34.

In certain embodiments, the tunneling apparatus 20 is used to form underground bores at precise grades. For example, the tunneling apparatus 20 can be used in the installation of underground pipe installed at a precise grade. In some embodiments, the tunneling apparatus 20 can be used to install underground pipe or other product having an outer diameter less than 600 mm or less than 300 mm.

It is preferred for the tunneling apparatus 20 to include a steering arrangement adapted for maintaining the bore being drilled by the tunneling apparatus 20 at a precise grade and line. For example, referring to FIG. 1, the drill head 30 includes a steering shell 36 mounted over the main body 38 of the drill head 30. Steering of the tunneling apparatus 20 is accomplished by generating radial movement between the steering shell 36 and the main body 38 (e.g., with radially oriented pistons, one or more bladders, mechanical linkages, screw drives, etc.). Radial steering forces for steering the drill head 30 are transferred between the shell 36 and the main body 38. From the main body 38, the radial steering forces are transferred through the drive stem 46 to the cutting unit 34.

In the subject embodiment, steering of the tunneling apparatus 20 is conducted in combination with a guidance system used to ensure the drill string 24 proceeds along a precise grade and line. In the depicted embodiment of FIG. 1, the guidance system includes a laser 40 that directs a laser beam 42 through a continuous axially extending air passage defined by the outer casing assemblies 28 of the pipe sections 22 to a target 44 located adjacent the drill head 30. The air passage extends from the proximal end to the distal end of the drill string 24 and allows air to be provided to the cutting unit 34.

The tunneling apparatus 20 also includes an electronic controller 50 (e.g., a computer or other processing device) linked to a user interface 52 and a monitor 54. The user interface 52 can include a keyboard, joystick, mouse or other interface device. The controller 50 can also interface with a camera 60 such as a video camera that is used as part of the steering system. For example, the camera 60 can generate images of the location where the laser hits the target 44. It will be appreciated that the camera 60 can be mounted within the drill head 30 or can be mounted outside the tunneling apparatus 20 (e.g., adjacent the laser). If the camera 60 is mounted at the drill head 30, data cable can be run from the camera through a passage that runs from the distal end to the proximal end of the drill string 24 and is defined by the outer casing assemblies 28 of the pipe sections 22. In still other embodiments, the tunneling apparatus 20 may include wireless technology that allows the controller to remotely communicate with the down-hole camera 60.

During steering of the tunneling apparatus 20, the operator can view the camera-generated image showing the location of the laser beam 42 on the target 44 via the monitor 54. Based on where the laser beam 42 hits the target 44, the operator can determine which direction to steer the apparatus to maintain a desired line and grade established by the laser beam 42. The operator steers the drill string 24 by using the user interface 52 to cause a shell driver 39 to modify the relative radial position of the steering shell 36 and the main body 38 of the drill head 30. In one embodiment, a radial steering force/load is applied to the steering shell 36 in the radial direction opposite to the radial direction in which it is desired to turn the drill string. For example, if it is desired to steer the drill string 24 upwardly, a downward force can be applied to the steering shell 36 which forces the main body 38 and the cutting unit 34 upwardly causing the drill string to turn upwardly as the drill string 24 is thrust axially in a forward/distal direction. Similarly, if it is desired to steer downwardly, an upward force can be applied to the steering shell 36 which forces the main body 38 and the cutting unit 34 downwardly causing the drill string 24 to be steered downwardly as the drill string 24 is thrust axially in a forward/distal direction.

In certain embodiments, the radial steering forces can be applied to the steering shell 36 by a plurality of radial pistons that are selectively radially extended and radially retracted relative to a center longitudinal axis of the drill string through operation of a hydraulic pump and/or valving. The hydraulic pump and/or valving are controlled by the controller 50 based on input from the user interface 52. In one embodiment, the hydraulic pump and/or the valving are located outside the hole being bored and hydraulic fluid lines are routed from pump/valving to the radial pistons via a passage that runs from the distal end to the proximal end of the drill string 24 and is defined within the outer casing assemblies 28 of the pipe sections 22. In other embodiments, the hydraulic pump and/or valving can be located within the drill head 30 and control lines can be routed from the controller 50 to the hydraulic pump and/or valving through a passage that runs from the distal end to the proximal end of the drill string 24 and is defined within the outer casing assemblies 28 of the pipe sections 22. In still other embodiments, the tunneling apparatus 20 may include wireless technology that allows the controller to remotely control the hydraulic pump and/or valving within the drill head 30.

To assist in drilling, the tunneling apparatus 20 can also include a fluid pump 63 for forcing drilling fluid from the proximal end to the distal end of the drill string 24. In certain embodiments, the drilling fluid can be pumped through a central passage defined through the drive shafts 26. The central passage defined through the drive shafts 26 can be in fluid communication with a plurality of fluid delivery ports provided at the cutting unit 34 such that the drilling fluid is readily provided at a cutting face of the cutting unit 34. Fluid can be provided to the central passage though a fluid swivel located at the drive unit 32.

The tunneling apparatus 20 can also include a vacuum system for removing spoils and drilling fluid from the bore being drilled. For example, the drill string 24 can include a vacuum passage that extends continuously from the proximal end to the distal end of the drill string 24. The proximal end of the vacuum passage can be in fluid communication with a vacuum 65 and the distal end of the vacuum passage is typically directly behind the cutting unit 34 adjacent the bottom of the bore. The vacuum 65 applies vacuum pressure to the vacuum passage to remove spoils and liquid from the bore being drilled. At least some air provided to the distal end of the drill string 24 through the air passage is also typically drawn into the vacuum passage to assist in preventing plugging of the vacuum passage. In certain embodiments, the liquid and spoils removed from the bore though the vacuum passage can be delivered to a storage tank 67.

Figure 2:
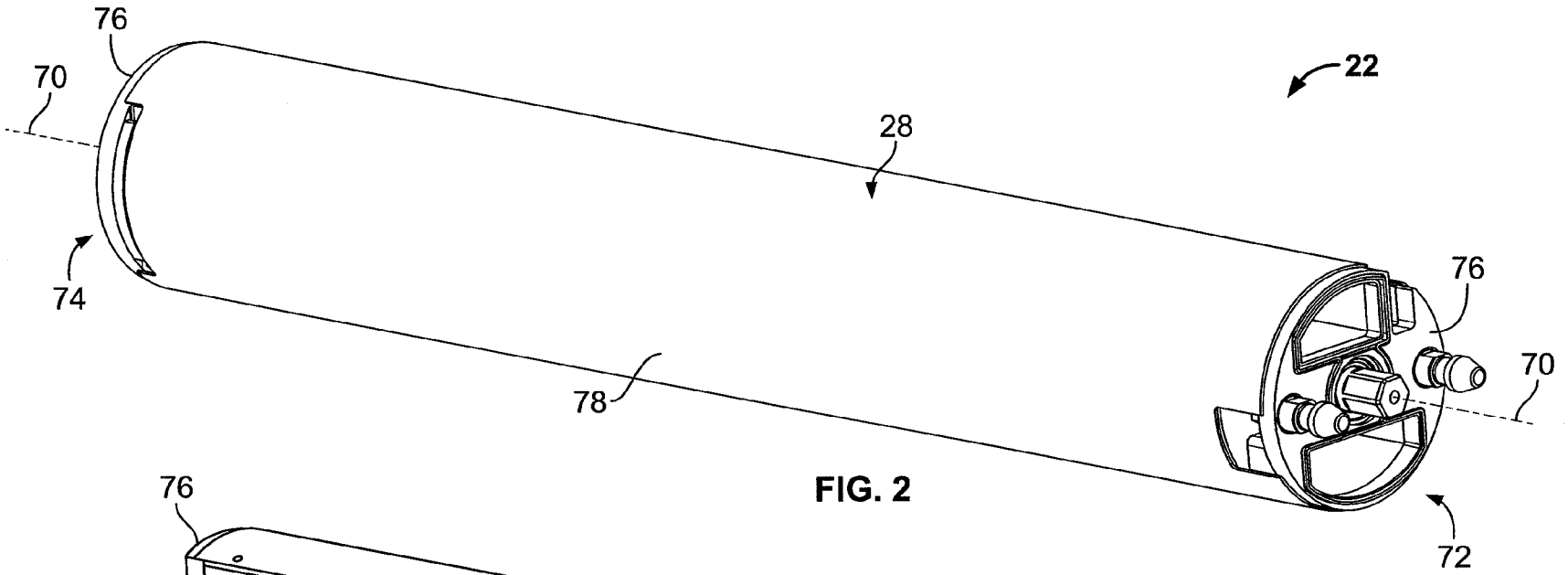
FIG. 2 is a perspective view of a pipe section suitable for use with the tunneling apparatus of FIG. 1.
Figure 3:
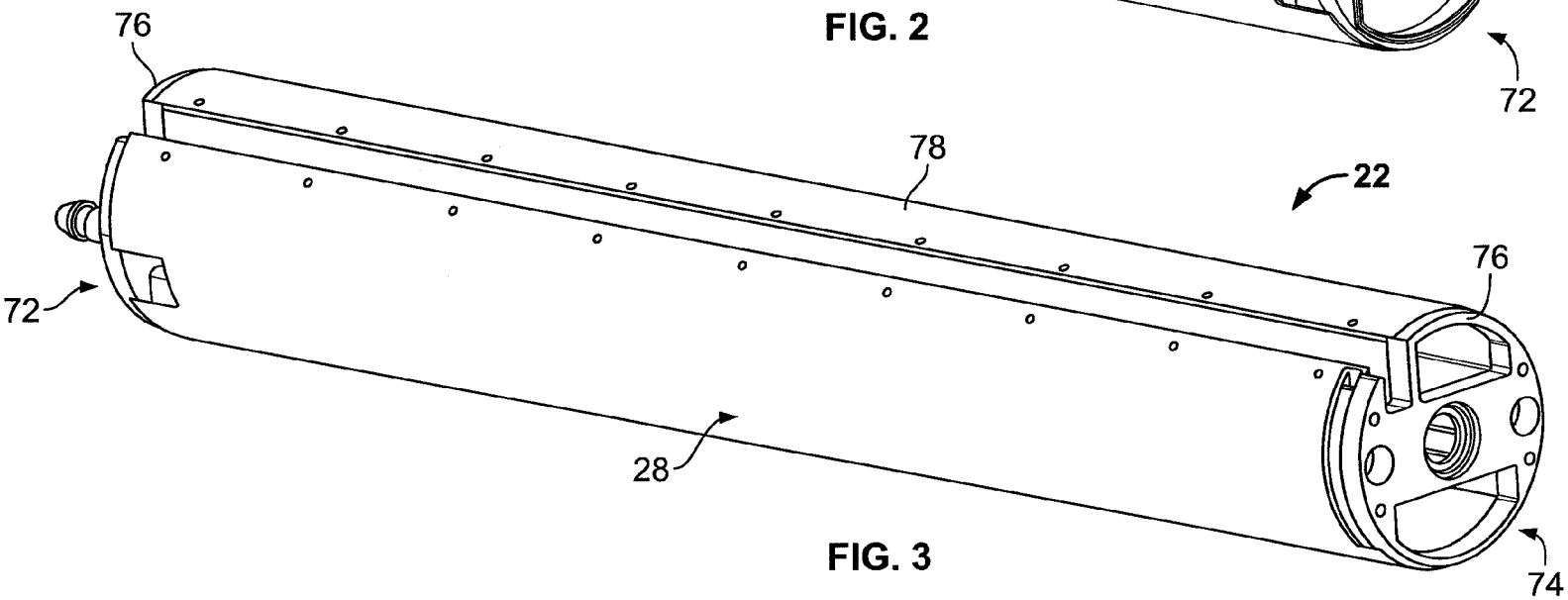
FIG. 3 is another perspective view of the pipe section of FIG. 2.
Figure 4:
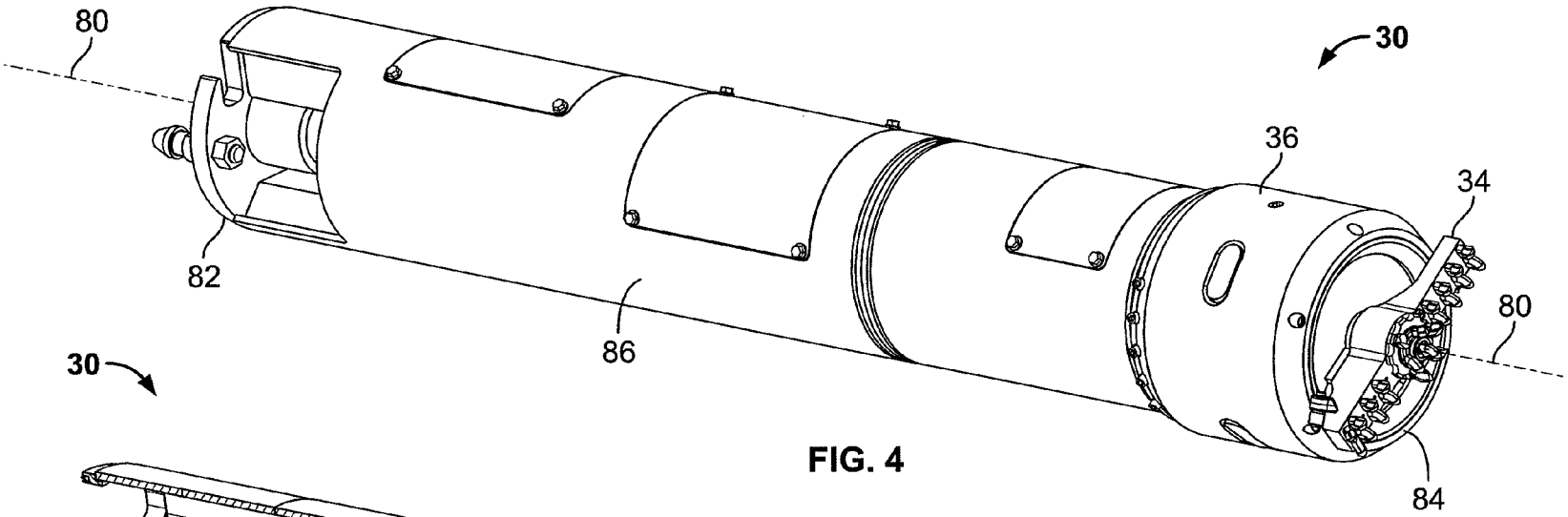
FIG. 4 is a perspective view of a distal end of a drill head suitable for use with the tunneling apparatus of FIG. 1.

Referring now to FIGS. 2 and 3, one of the pipe sections 22 is shown. The pipe section 22 is elongated along a central axis 70 and includes a male end 72 and an oppositely positioned female end 74. When a plurality of the pipe sections 22 are strung together, the female ends 74 are coupled to the male ends 72 of the adjacent pipe sections 22.

The outer casing assembly 28 of the depicted pipe section 22 includes end plates 76 positioned at the male and female ends 72, 74. The outer casing assembly 28 also includes an outer shell 78 that extends from the male end 72 to the female end 74. The outer shell 78 is generally cylindrical and defines an outer diameter of the pipe section 22. In a preferred embodiment, the outer shell 78 is configured to provide support to a bore being drilled to prevent the bore from collapsing during the drilling process.

Referring now to FIGS. 4-7, an embodiment of the drill head 30 of the tunneling apparatus 20 is shown. The drill head 30 is elongated on a central longitudinal axis 80 that extends from a proximal end 82 to a distal end 84 of the drill head 30. The proximal end 82 of the drill head 30 is configured to be mechanically coupled to the distal end of the distal-most pipe section 22 of the drill string 24. In the depicted embodiment, the axis 80 of the drill head 30 is coaxially aligned with the overall central axis defined by the pipe sections 22 of the drill string 24 when the proximal end 82 coupled to the distal end of the distal-most pipe section 22.

The cutting unit 34 and the steering shell 36 are mounted at the distal end 84 of the drill head 30. The main body 38 of the drill head 30 includes a cylindrical outer cover 86 that extends generally from the steering shell 36 to the proximal end 82 of the drill head 30. The steering shell 36 has a larger outer diameter than the outer diameter of the cover 86.

Referring still to FIGS. 4-7, the steering shell 36, which is suitable for use with the drill head 30, is shown. The steering shell 36 includes a body 100 having a proximal end 102 and an oppositely disposed distal end 104. The body 100 of the steering shell 36 defines a bore 106 that extends through the proximal and distal ends 102, 104. The bore 106 has an inner surface 108. The steering shell 36 is mounted over modules 109*a*-109*f* at the distal end of the drill head 30.

The body 100 of the steering shell 36 includes an outer surface 110 that extends between the proximal and distal ends 102, 104. The body 100 defines a plurality of openings 112 that extends through the inner and outer surfaces 108, 110 of the body 100. While the openings 112 can have various shapes, the openings 112 are generally around in the subject embodiment. In the depicted embodiment, there are four openings 112 that are symmetrically disposed about body 100.

The steering shell 36 includes a plurality of contact pads 114. The contact pads 114 are disposed in the openings 112 of the body 100. Each of the contact pads 114 includes an inner contact surface 116. The contact pads 114 are adapted to move radially in the openings 112.

To promote steering, the steering shell 36 is radially movable relative to the modules 109*a*-109*f* of the main body 38. In one embodiment, the steering shell 36 is radially movable in 360 degrees relative to the modules 109*a*-109*f*. Shell retainers 117*a*, 117*b* in the form of rings or partial rings are secured to the proximal and distal ends 102, 104 of the steering shell 36. The shell retainers 117*a*, 117*b* radially overlap the module 109*b* and the module 109*f*, respectively, which limits the axial movement of the steering shell 36 relative to the main body 38.

Figure 6:
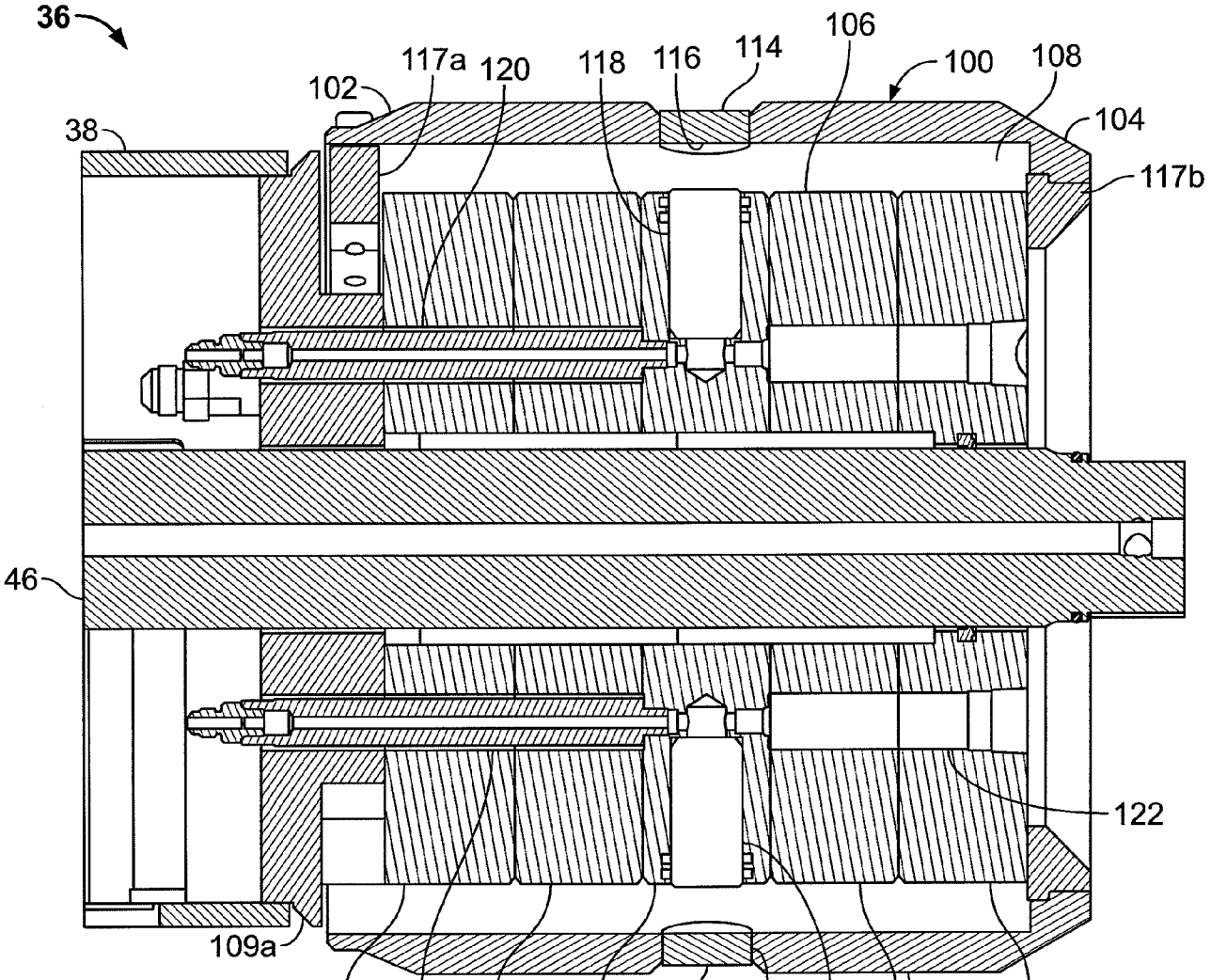
FIG. 6 is a side, cross-sectional view of a distal end portion of the drill head of FIG. 4 with the distal end portion of the drill head being cut along a vertical cross-sectional plane that extends along a central longitudinal axis of the drill head and bisects the distal end portion of the drill head.
Figure 7:
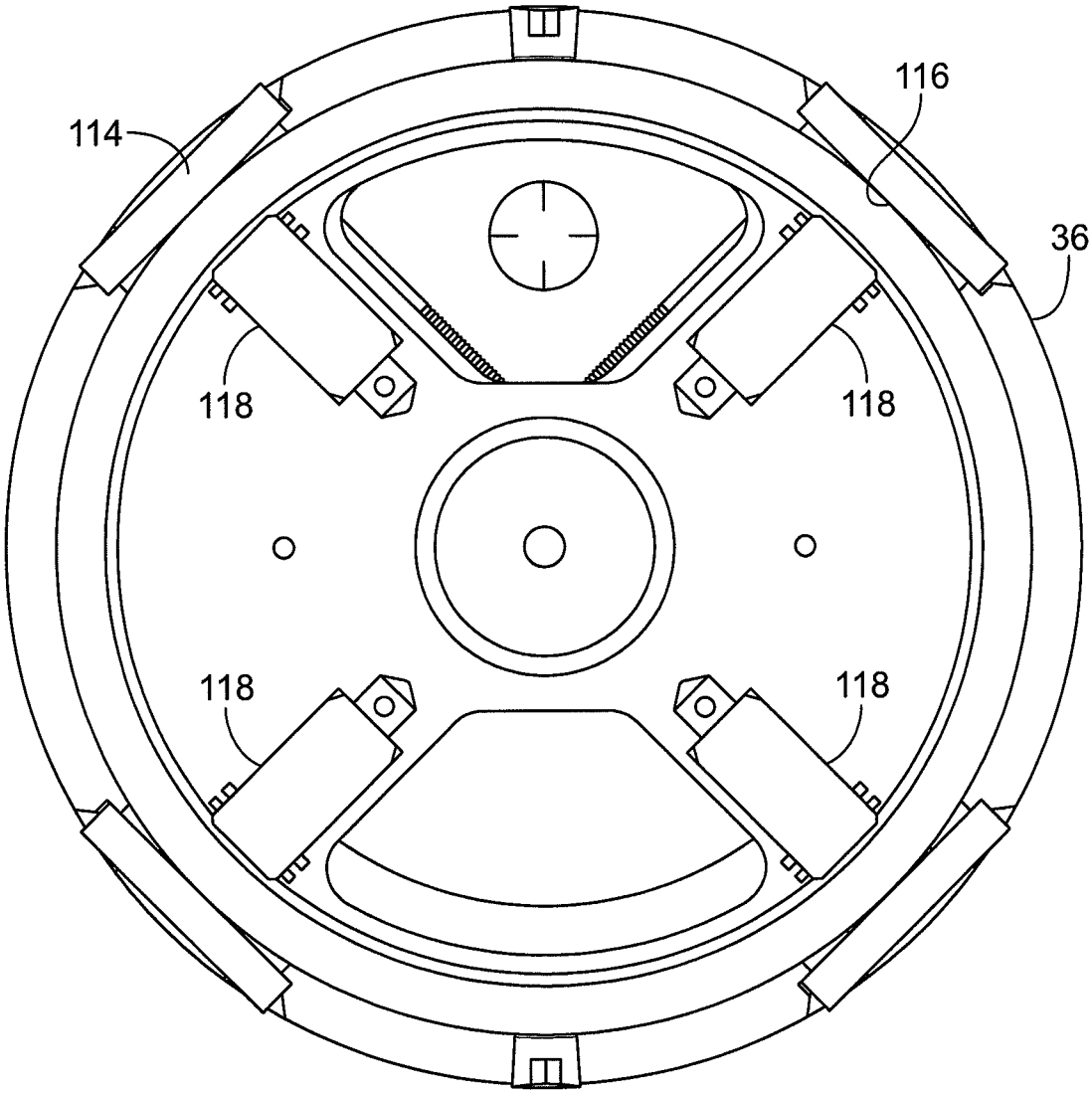
FIG. 7 is a transverse cross-sectional view of the drill head of FIG. 4 showing radial pistons for moving a steering shell of the drill head, the cross-section is taken along a vertical cross-section plane that is perpendicular to the central longitudinal axis of the drill head.
Figure 8:
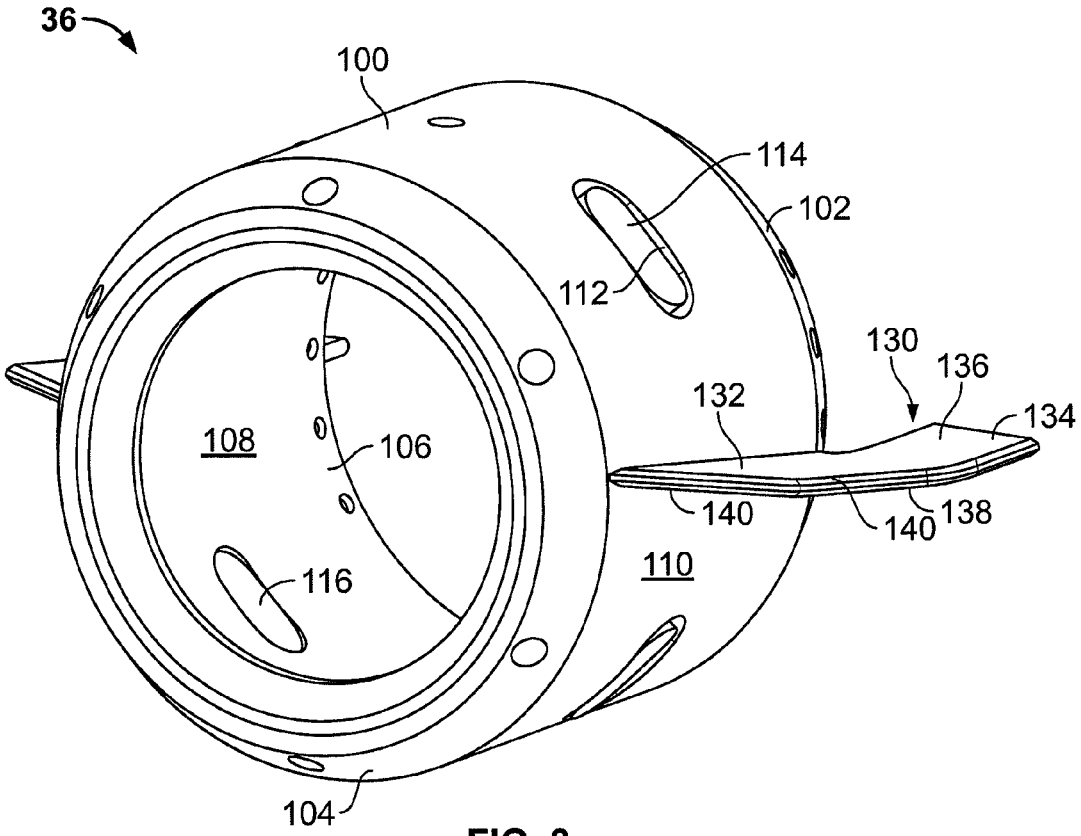
FIG. 8 is a perspective view of a steering shell suitable for use with the drill head of FIG. 4.
Figure 9:
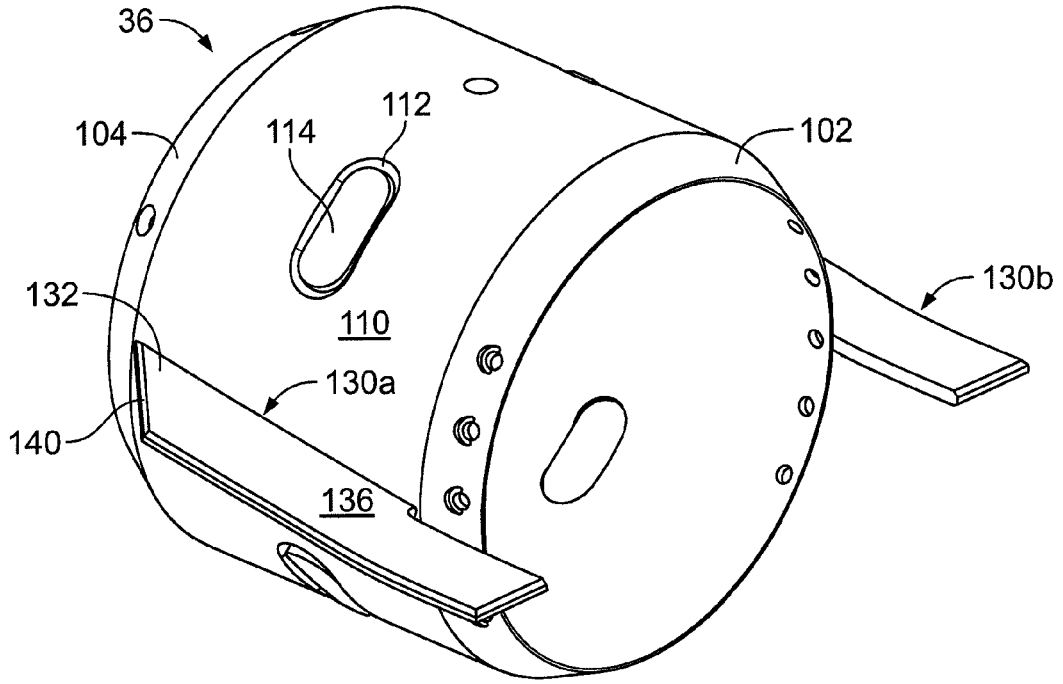
FIG. 9 is another perspective view of a steering shell of FIG. 8.
Figure 10:
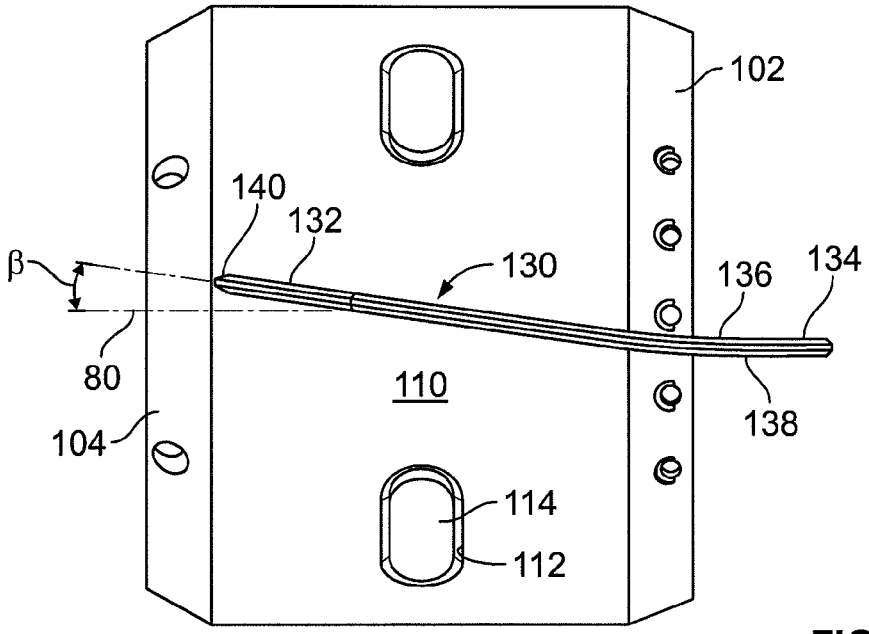
FIG. 10 is a side view of the steering shell of FIG. 8.
Figure 11:
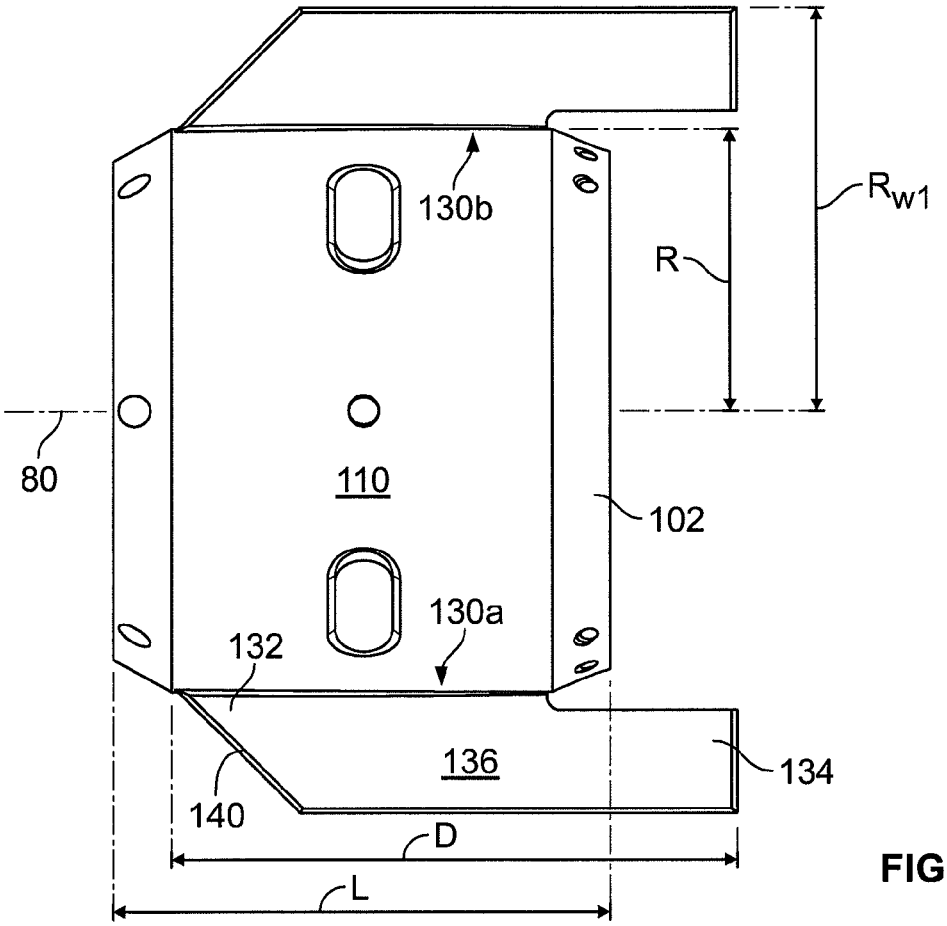
FIG. 11 is a top view of the steering shell of FIG. 8.
Figure 12:
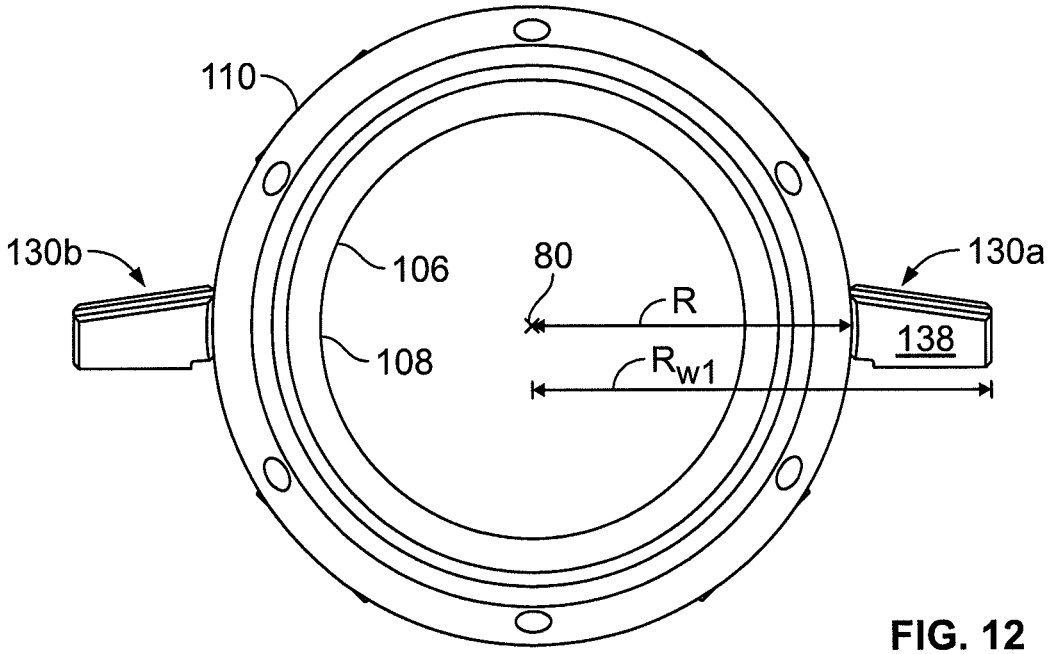
FIG. 12 is a front view of the steering shell of FIG. 8.

Relative radial movement between the main body 38 of the drill head 30 and the steering shell 36 is controlled by radial pistons 118 (e.g., four radial pistons) mounted within radial piston cylinders defined within the module 109*d*. The piston cylinders are angularly spaced from one another by approximately 90 degrees about the central longitudinal axis 80. The pistons 118 are extended and retracted by fluid pressure (e.g., hydraulic fluid pressure) provided to the piston cylinders through axial hydraulic fluid passages 120 defined by the modules 109*a*-109*d*. A hydraulic fluid bleed passage 122 is also defined through the modules 109*e* and 109*f* for each piston cylinder (only two passages are shown at FIG. 6). The bleed passages 122 are plugged when it is not needed to bleed the hydraulic fluid lines corresponding to the steering system.

When the pistons 118 are extended, outer ends 124 of the pistons 118 engage inner contact surfaces 116 of contact pads 114 of the steering shell 36. The inner contact surfaces 116 preferably are flat when viewed in a cross-section taken along a plane perpendicular to the central axis 80 of the drill head 30. Thus, the inner contact surfaces 116 preferably include portions that do not curve as the portions extend generally in a shell sliding direction. The slide directions are defined within a plane generally perpendicular (i.e., perpendicular or almost perpendicular) to the central longitudinal axis 80 of the drill head 30. The slide directions are also generally perpendicular to central longitudinal axes defined by the radial pistons 118. The contact pads 114 are formed by inserts secured within openings 112 defined by the body 100 of the steering shell 36.

While it is preferred for the inner contact surfaces 116 to be flat in the orientation stated above, it will be appreciated that in other embodiments the inner contact surfaces 116 could be slightly curved or otherwise non-flat in the slide direction. It is preferred for the inner contact surfaces 116 to have a flattened configuration in the slide direction as compared to a curvature along which the inner surface 108 of the main body 100 of the shell 36 extends. By flattened configuration, it is meant that the inner contact surfaces 116 are flatter than the inner surface 108 of the main body 100 of the shell 36 in the slide direction. The flattened configuration of the inner contact surfaces 116 of the contact pads 114 allows the steering shell 36 and the outer ends 124 of the radial pistons 118 to slide more freely or easily relative to one another in response to extension and retraction of selected ones of the radial pistons 118. Thus, the flattened configuration of the contact pads 114 along the slide directions assists in preventing binding during repositioning of the shell 36.

In other embodiments, pneumatic pressure can be used to move the pistons 118. In still other embodiments, structures other than pistons can be used to generate relative lateral movement between the steering shell 36 and the main body 38 (e.g., bladders that can be inflated and deflated with air or liquid, screw drives, mechanical linkages, etc.).

Figure 5:
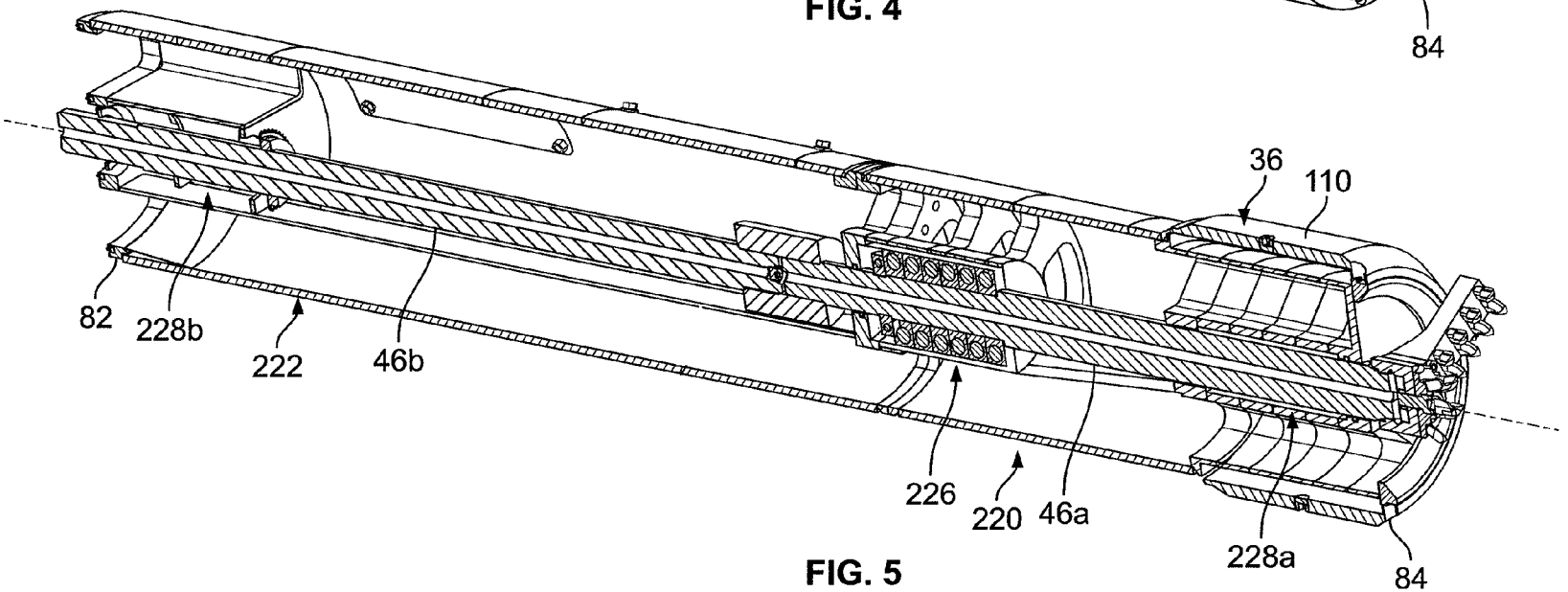
FIG. 5 is a perspective, cross-sectional view of the drill head of FIG. 4 taken along a vertical plane that longitudinally bisects the drill head.

Referring to FIG. 5, the drill head 30 includes a distal section 220 and a proximal section 222 which are connected at a joint 224. The drive stem 46 includes a distal portion 46*a* that extends through the distal section 220 and a proximal portion 46*b* that extends through the proximal section 222. The distal and proximal portions 46*a*, 46*b* are connected by a coupling provided at the joint 224. The drive stem 46 is supported by an axial/thrust bearing structure 226 mounted in the distal section 220 adjacent the joint 224. The drive stem 46 is also supported by radial bearing structures 228*a*, 228*b* provided adjacent the distal and proximal ends 84, 82 of the drill head 30. The distal radial bearing structures 228*a* are incorporated inside the modules 109*a*-109*f* over which the steering shell is mounted. Thus, the steering shell 36 is radially moveable relative to the radial bearing structures 228*a*.

In certain embodiments of the present disclosure, the distal section 220 of the drill head 30 can have a configuration adapted for stabilizing the drill head 30 in soft, wet or loose ground conditions such as sand or mud. For example, certain embodiments, the distal section 220 can include stabilizing extensions (e.g., wings, blades, fins or other stabilizers) that project outwardly from the distal section 220. In some embodiments, these stabilizing extensions can increase downwardly facing surface area of the distal section 220 by at least 10%, by at least 20%, by at least 30%, or by at least 50%. In certain embodiments, these stabilization structures can be provided on the steering shell 36 of the distal section 220. As used herein, the steering shell 36 is considered to be part of the distal section 220 of the drill head 30. In certain embodiments (see FIGS. 24 and 25), the stabilization extensions can be extended outwardly from and retracted into the body of the distal section 220.

FIGS. 8-12 show a modified steering shell 36' including a plurality of wings 130 (i.e., blades, fins, stabilizers, etc.) that extend outwardly from the outer surface 110. The steering shell 36' may include mounting pads to which the wings 130 are attachable. The wings 130 are adapted to maintain the desired location of the steering shell 36' in areas of soft earth (e.g., mud, sand, etc.) during a boring operation. The wings 130 extend radially outwardly from the body 100 so that a radial distance $R_{W1}$ to an outermost edge of the wing 130 (i.e., measured from the central longitudinal axis 80 of the drill head 30 to the outermost edge of one of the wings 130 in a direction that is generally perpendicular to the central longitudinal axis 80) is greater than a radial distance R to the outer surface 110 of the body 100. In one embodiment, the radial distance $R_{W1}$ of the wings 130 is greater than or equal to 105% of the radial distance R of the outer surface 110. In another embodiment, the radial distance $R_{W1}$ of the wings 130 is greater than or equal to 110% of the radial distance R of the outer surface 110. In another embodiment, the radial distance $R_{W1}$ of the wings 130 is greater than or equal to 120% of the radial distance R of the outer surface 110. In another embodiment, the radial distance $R_{W1}$ of the wings 130 is greater than or equal to 130% of the radial distance R of the outer surface 110. In another embodiment, the radial distance $R_{W1}$ of the wings 130 is greater than or equal to 135% of the radial distance R of the outer surface 110. In another embodiment, the radial distance $R_{W1}$ of the wings 130 is greater than or equal to 140% of the radial distance R of the outer surface 110. In the depicted embodiment, the radial distance $R_{W1}$ of the wings 130 is greater than a radial distance to an outermost edge of the cutter unit 34.

In the depicted embodiment, the steering shell 36' includes a first wing 130*a* and a second wing 130*b*. The first and second wings 130*a*, 130*b* are disposed on the outer surface 110 so that the second wing 130*b* is generally about 180 degrees from the first wing 130*a*.

Each of the first and second wings 130*a*, 130*b* includes a leading end 132 and a tail end 134. The leading end 132 is disposed adjacent to the distal end 102 of the body 100. The distance that the leading end 132 extends outwardly from the outer surface 110 increases as the distance from the distal end 102 of the body 100 increases. In the depicted embodiment, the leading end 132 flares outwardly from the outer surface 110 as the distance from the distal end 102 of the body 100 increases.

In the depicted embodiment, the tail end 134 of each of the first and second wings 130*a*, 130*b* extends beyond the proximal end 104 of the body 100. Each of the first and second wings 130*a*, 130*b* extends an axial distance D measured from the distal-most point on the leading end 132 to the proximal-most point on the tail end 134. In the depicted embodiment, the axial distance D is greater than a length L of the body 100.

Each of the first and second wings 130*a*, 130*b* includes an upper surface 136 and a lower surface 138. Each of the upper surface 136 and the lower surface 138 of the first and second wings 130*a*, 130*b* includes a perimeter portion 140. In the depicted embodiment, a width W measured between the upper and lower surfaces 136, 138 in the perimeter portions 140 of the first and second wings 130*a*, 130*b* decreases as the measured location moves outwardly in the perimeter portions 140. In another embodiment, at least one of the perimeter portions 140 of the upper and lower surfaces 136, 138 is tapered.

In the depicted embodiment, the tail end 134 of each of the first and second wings 130*a*, 130*b* is generally parallel to the central longitudinal axis 80 of the drill head 30 when the contact pads 114 of the steering shell 36 are fully retracted. Each of the first and second wings 130*a*, 130*b* defines an angle $\alpha$ between the upper surface 136 of the leading end 132 and the upper surface 136 of the tail end 134. In the depicted embodiment, the angle α is in a range between about 150 degrees to about 180 degrees. In another embodiment, the angle α is in a range between about 160 degrees to about 180 degrees. In another embodiment, the angle α is in a range between about 170 degrees to about 180 degrees.

In the depicted embodiment, each of the wings 130 is disposed on the outer surface 110 of the steering shell 36 so that the leading end 132 has an oblique angle of inclination β relative to the central longitudinal axis 80. In one embodiment, the angle of inclination β is less than or equal to about 30 degrees. In another embodiment, the angle of inclination β is less than or equal to about 20 degrees. In another embodiment, the angle of inclination β is less than or equal to about 10 degrees.

In one embodiment, the angle of inclination of each of the first and second wings 130*a*, 130*b* is adjustable. In one embodiment, the angle of inclination can be adjusted manually, hydraulically, pneumatically or electrically.

Figure 24:
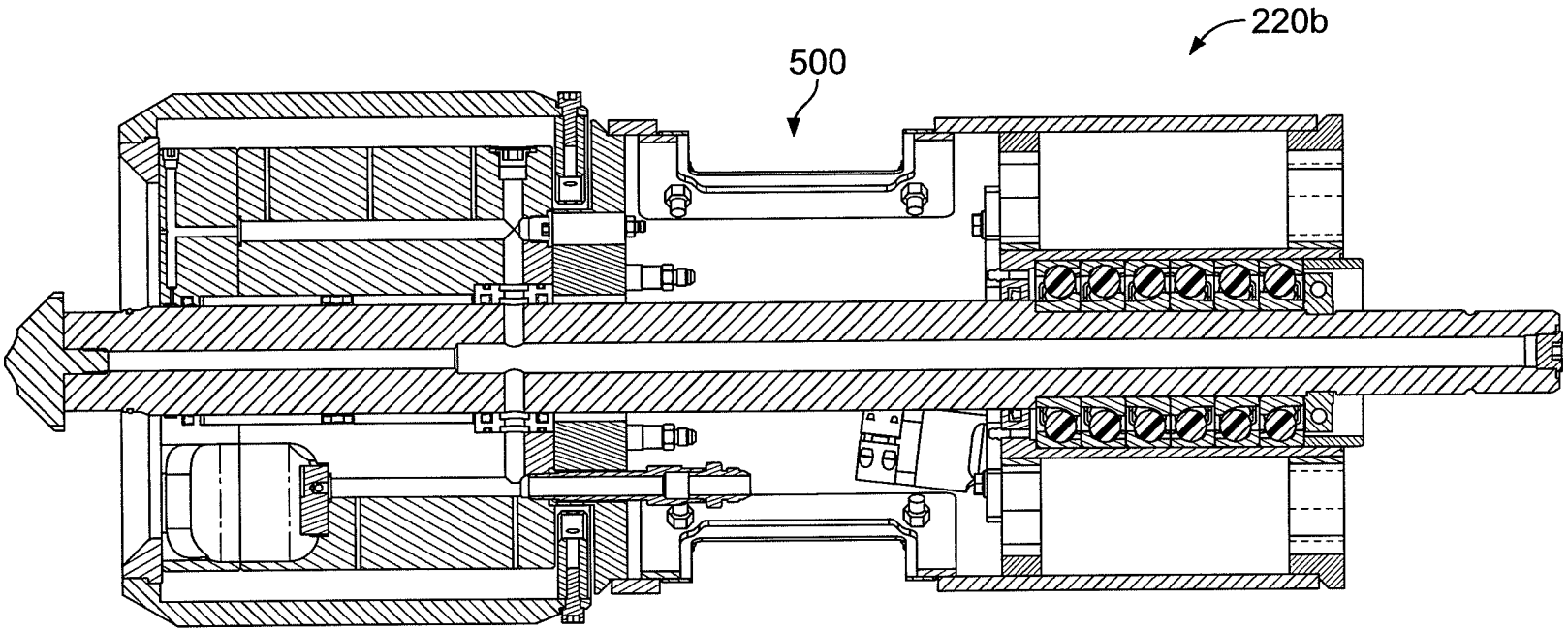
FIG. 24 is a side, cross-sectional view of still another alternative distal drill head section taken along a vertical plane that longitudinally bisects the drill head.
Figure 25:
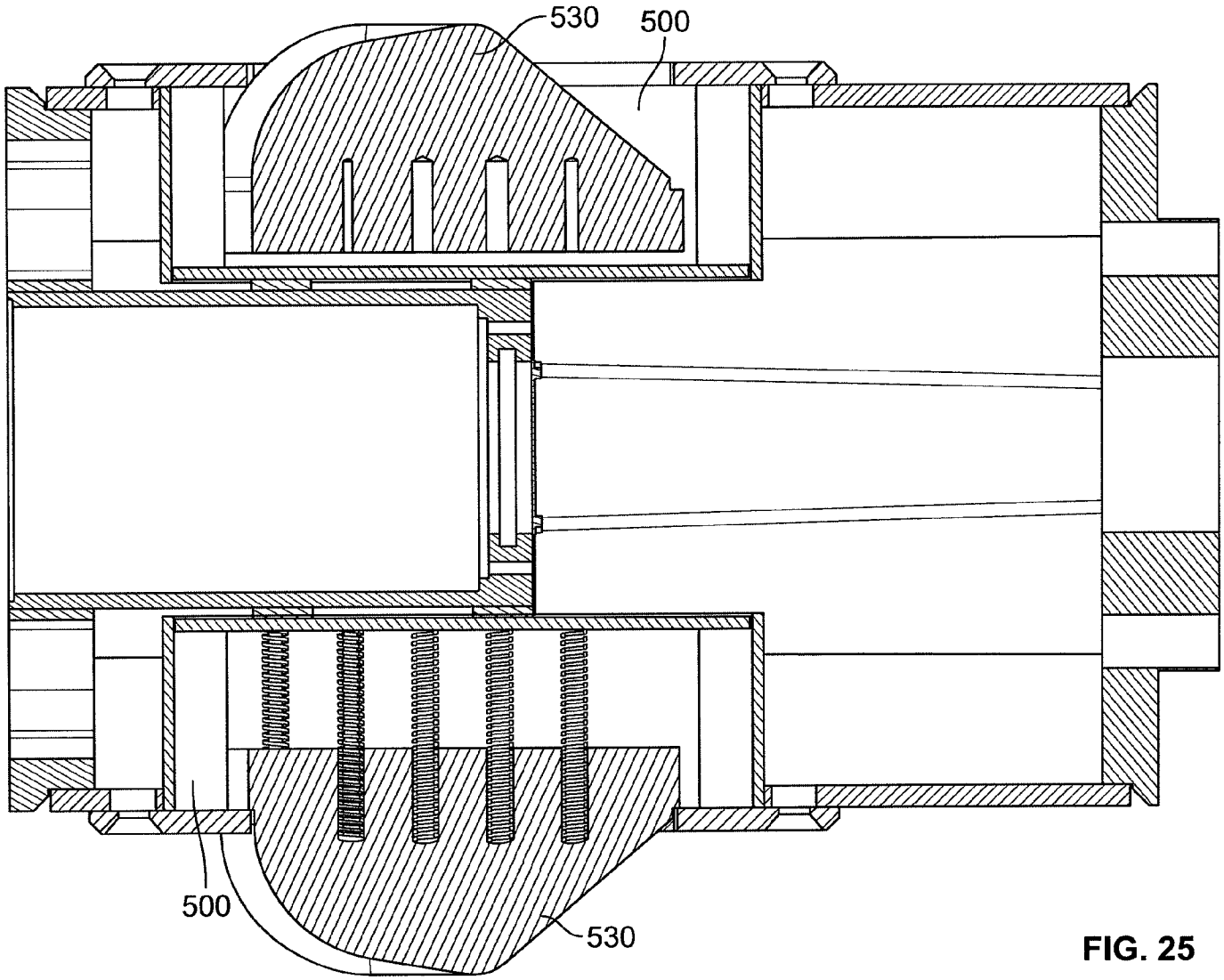
FIG. 25 shows fins that retractably mount within pockets of the distal drill head section of FIG. 24.

In another embodiment, each of the first and second wings 130*a*, 130*b* is extendable in a radially outward direction from the outer surface 110. The radial extension of the first and second wings 130*a*, 130*b* can be adjusted in order to provide more stability in softer ground conditions. In one embodiment, the first and second wings 130*a*, 130*b* telescope outwardly from the outer surface 110. FIGS. 24 and 25 show a further distal section 220*b* having the same general configuration as the distal section 220 except pockets 500 have been added at a location proximal to the steering shell 36 for mounting stabilizing wings 530. The stabilizing wings 530 can be selectively extended or retracted from the pockets 500 to adjust the degree of stability provided to the drill head. In certain embodiments, mechanisms such as screw drives, hydraulic cylinders, pneumatic cylinders, or other mechanisms can be used to allow the distance the wings project outwardly from the main body of the drill head to be adjusted. It will be appreciated that the mechanisms can be controlled from above ground to allow the distance the wings project outwardly from the drill head to be controlled on the fly during drilling. Alternatively, the mechanisms can be configured such that the degree of the extension of the wings can be preset before drilling to match an anticipated drilling condition.

In still other embodiments, other features for enhancing drilling performance by allowing the drill head to maintain a precise line of travel even in soft ground conditions can be incorporated into the distal section 220 of the drill head 30. For example, the distal section 220 of the drill head 30 can include a pivot structure provided between the main body of the distal section 22 and the steering shell 36. The pivot structure can allow the shell 36 to be selectively angled relative to the central axis of the drill head 30. For example, a nose of the steering shell can be angled upwardly relative to the central axis of the drill head 30 such that a bottom surface of the steering shell inclines upwardly toward the central axis of the drill head as the steering shell extends in a proximal-to-distal direction. When angled in this configuration, the bottom surface of the steering shell provides a ramp that assists in lifting the distal section 220 of the drill head 30 as the drill head 30 is forced in a distal direction. By angling the nose of the steering shell 36 in a downward direction relative to the central axis of the drill head 30, an upper surface of the steering shell 36 forms a ramp that declines (e.g., angles downwardly) toward the central axis of the drill head 30 as the upper surface of the steering shell 36 extends in a proximal-to-distal direction. In this configuration, the ramp provided at the upper surface of the steering shell 36 forces the distal section 220 of the drill head 30 in a downward direction as the drill head 30 is forced in a distal direction. By angling the nose of the steering shell 36 leftwardly relative to the central axis of the drill head 30, a right side of the steering shell 36 forms a ramp surface that angles in a leftward direction toward the central axis of the drill head 30 as the right outer surface of the steering shell extends in a proximal-to-distal direction. In this way, the right outer surface of the steering shell 36 functions as a ramp that urges the distal section 220 of the drill head 30 in a leftward direction as the drill head 30 is forced in a distal direction. Similarly, the nose of the steering shell 36 can be angled in a rightward orientation relative to the central axis of the drill head such that a left outer surface of the steering shell 36 angles in a rightward direction toward the central axis of the drill head 30 as the leftward outer surface of the steering shell 36 extends in a proximal-to-distal direction. In this way, the leftward outer surface of the steering shell functions as a ramp that urges the distal section 220 in a rightward direction as the drill head 30 is forced in a distal direction.

In certain embodiments, the pivot structure between the main body of the distal section 220 and the steering shell 36 can include a universal joint that allows the steering shell to be universally pivoted about the central axis of the drill head 30. In certain embodiments, the universal joint can include opposing surfaces that extend generally along a boundary defined by a portion of a sphere. In certain embodiments, surfaces themselves can have a curvature that corresponds with a portion of a sphere. In certain embodiments, the steering shell 36 is pivoted relative to the main body of the distal section 220 by a motive structure such as radial pistons that are offset from the pivot structure along the central axis of the drill head 30. In certain embodiments, a motive structure for pivoting the steering shell 36 relative to the main body of the distal section 220 is proximally offset from the pivot structure provided between the steering shell 36 and the main body of the distal section 220. In still further embodiments, stabilization extensions of the type described above can be provided on the pivotal steering shell to further enhance the ability of the drill head 32 remain on line when used in soft, loose or wet ground conditions.

In certain embodiments, a nose of the steering shell can be pivoted to an upwardly angled position, a downwardly angled position, a leftwardly angled position, and a rightwardly angled position. Furthermore, by using a universal joint, the nose of the steering shell can be pivoted in any rotational direction between the upwardly angled position, the downwardly angled position, the leftwardly angled position and the rightwardly angled position. For example, if the upwardly angled position corresponds to a 12 o'clock clock position, the downwardly angled position corresponds to a 6 o'clock clock position, the leftwardly angled position corresponds to the 3 o'clock clock position and the rightwardly angled position corresponds to the 9 o'clock clock position, the universal joint allows the nose of the steering shell to be angled toward any clock position between any of the main clock positions mentioned above. For example, the nose of the steering shell can be angled toward the 1 o'clock position, the 2 o'clock position, the 3 o'clock position, the 4 o'clock position, the 5 o'clock position, the 6 o'clock position, the 7 o'clock position, the 8 o'clock position, the 9 o'clock position, the 10 o'clock position, the 11 o'clock position, and the 12 o'clock position.

FIGS. 13-22 illustrate an alternative configuration for a distal section 220*a* of the drill head 30. The distal section 220*a* has been modified with respect to the distal section 220 to include a pivotal shell 36*a* that can be pivoted relative to a main body 38*a* of the distal section 220*a*. It will be appreciated that the distal section 220*a* has the same basic features as the distal section 220 except for the modifications made to facilitate pivotal movement of the shell 36*a*. Optimally, stabilization wings 230 can be provided on the steering shell 36*a*.

Figure 13:
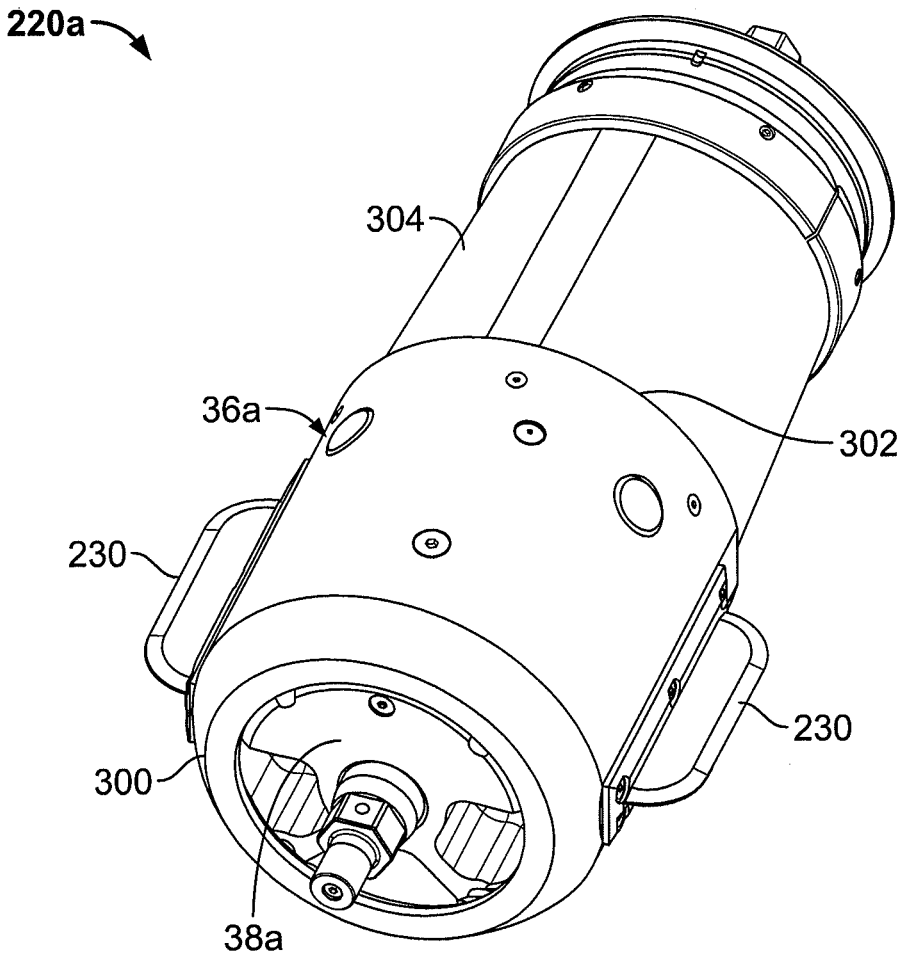
FIG. 13 is a front, perspective view of a distal section of another drill head in accordance with the principles of the present disclosure.
Figure 14:
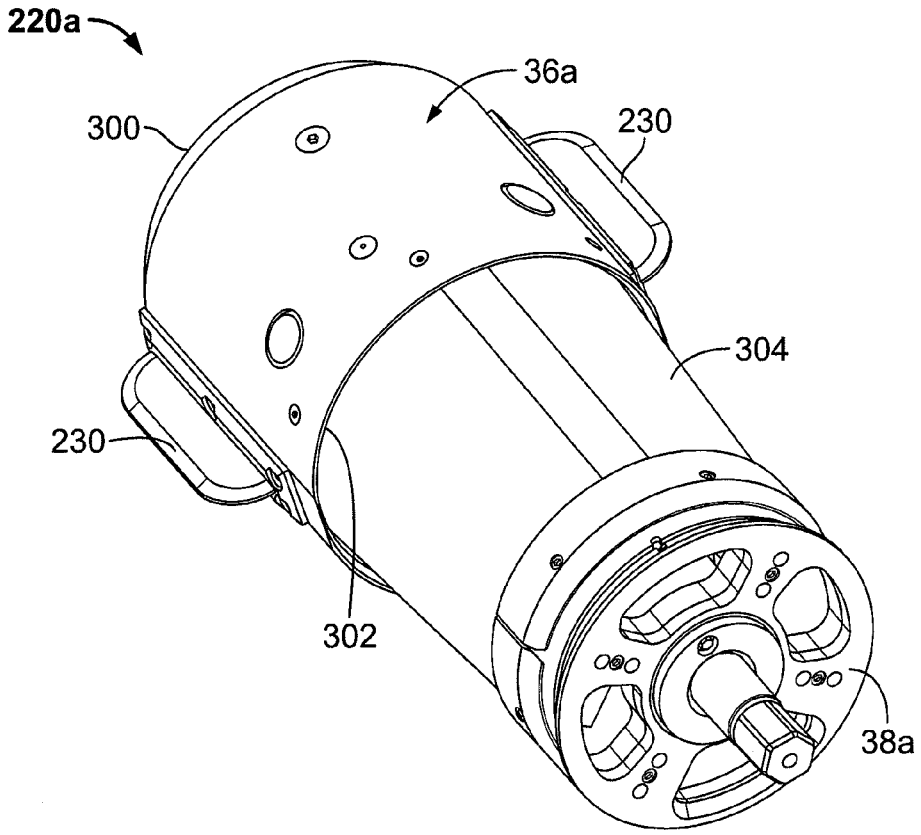
FIG. 14 is a rear, perspective view of the distal drill head section of FIG. 13.
Figure 15:
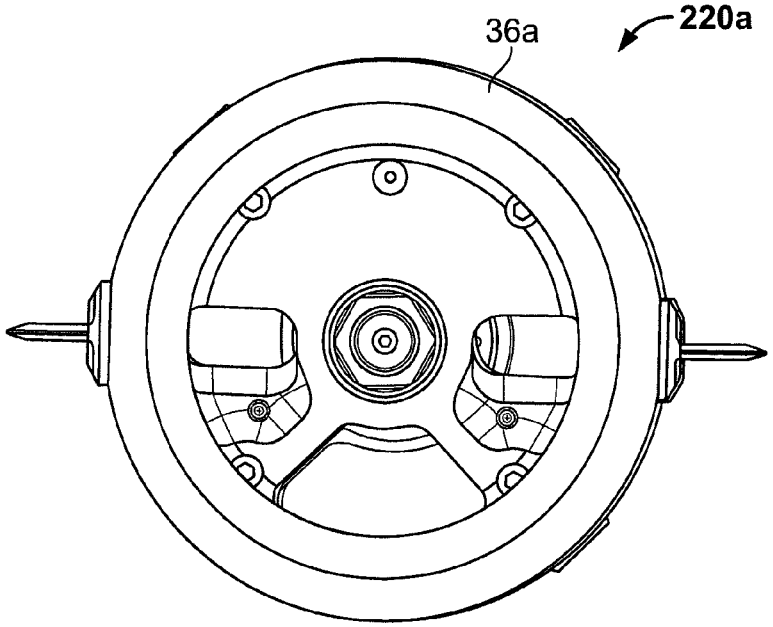
FIG. 15 is a front end view of the distal drill head section of FIG. 13.
Figure 16:
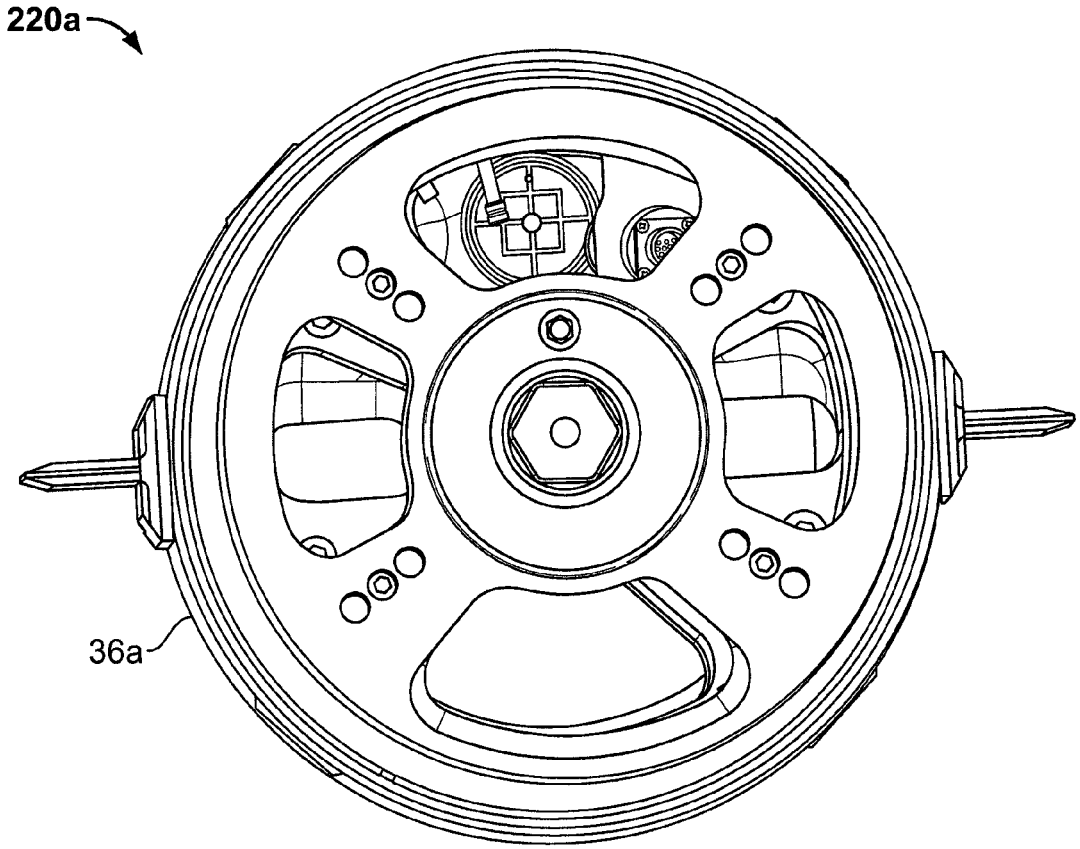
FIG. 16 is a rear end view of the distal drill head section of FIG. 13.
Figure 17:
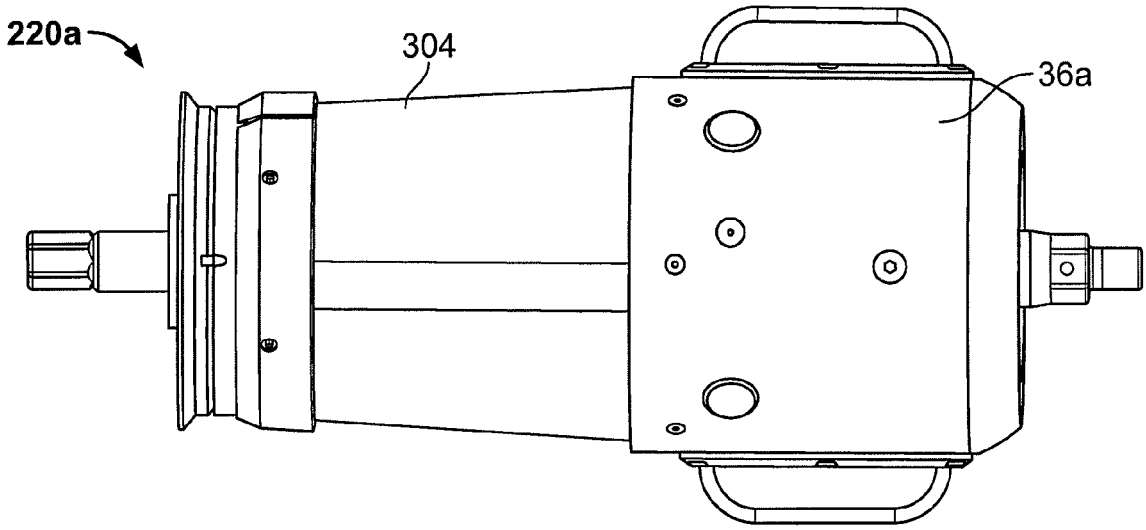
FIG. 17 is a top view of the distal drill head section of FIG. 13.

Referring to FIGS. 13 and 14, the steering shell 36*a* includes a distal end 300 and a proximal end 302. The distal end 300 forms a front nose of the shell 36*a*. Stabilizing wings 130*a* are mounted at left and right sides of the shell 36*a*. A flexible skirt 304 extends from the proximal end 302 of the shell 36 to the main body 38*a* of the distal section 220*a*. The flexible nature of the skirt 304 allows the shell 36*a* to pivot relative to the main body 38*a* while concurrently preventing debris from getting under the shell. As shown at FIG. 19, the skirt 304 has a distal end 305 that is secured to the proximal end 302 of the shell 36*a* with an inner collar 306 and the skirt 304 includes a proximal end 307 that is secured to the main body 38*a* with an outer collar 308.

Figure 18:
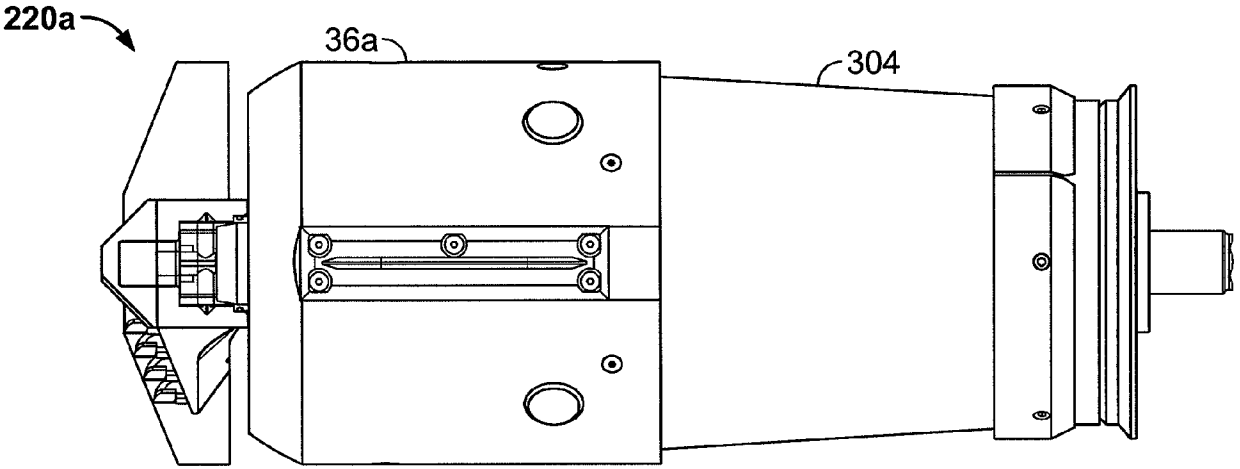
FIG. 18 is a side view of the distal drill head section of FIG. 13 with a steering shell shown in a straight drilling position.
Figure 19:
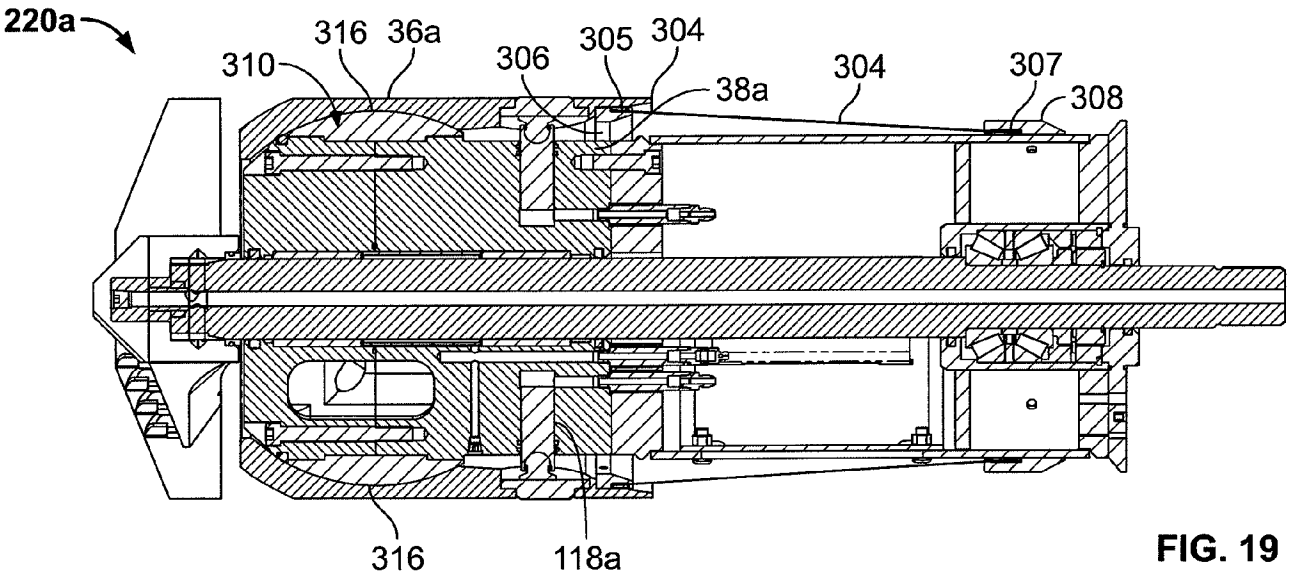
FIG. 19 is a cross-sectional view of FIG. 18 taken along a vertical cross-section plane that bisects the distal section.
Figure 20:
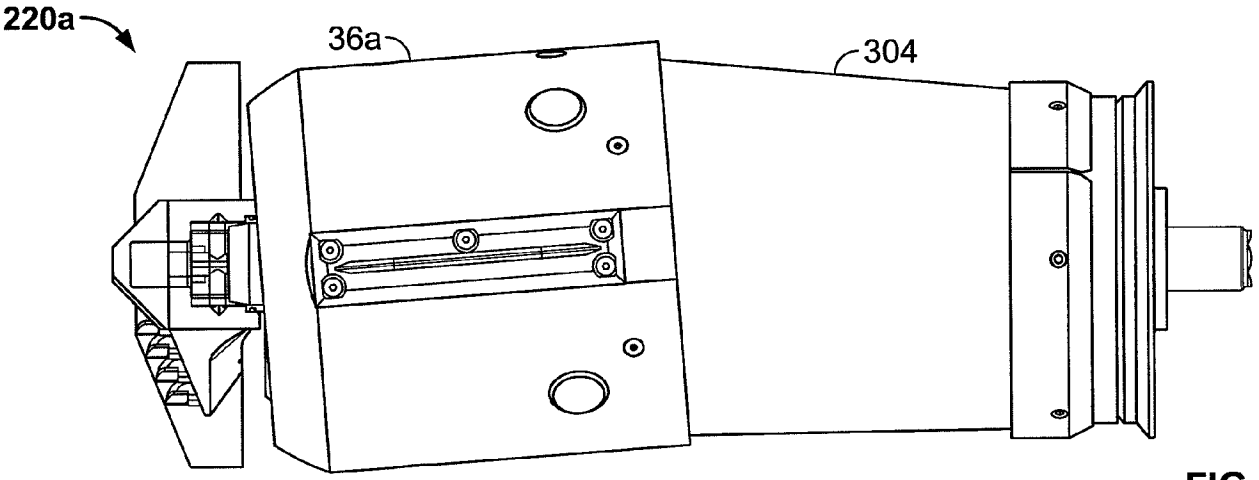
FIG. 20 is a side view of the distal drill head section of FIG. 13 with a steering shell shown in a downwardly angled drilling position.
Figure 21:
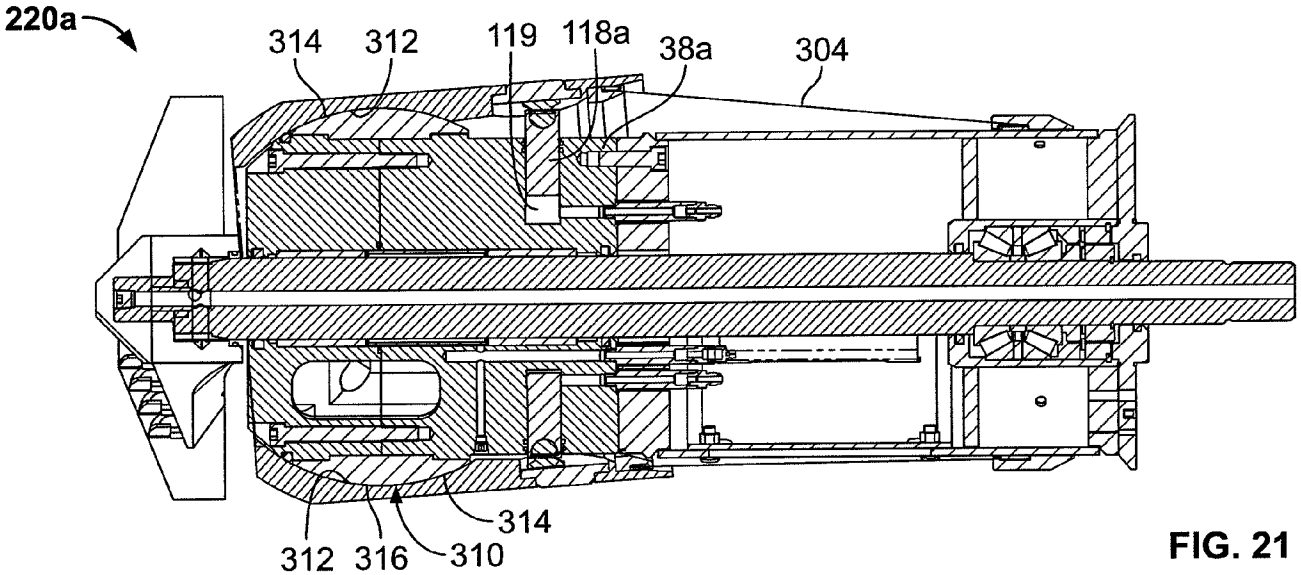
FIG. 21 is a cross-sectional view of FIG. 20 taken along a vertical cross-section plane that bisects the distal section.

As shown at FIGS. 19 and 21, the distal section 220*a* also includes a pivot structure 310 that allows the shell 36*a* to pivot universally relative to the main body 38*a* of the distal section 220*a*. In the depicted embodiment, the pivot structure 310 includes a universal joint formed by a concave surface 312 provided on the inside of the shell 36*a* that opposes and engages a corresponding convex surface 314 provided on the main body 38*a* of the distal section 220*a*. The concave surface 312 and the convex surface 314 both form annular shapes that extend around a central axis of the distal section 220*a*. In one embodiment, both surfaces 312, 314 extend along an interface boundary 316 that is defined by a portion of a sphere having a center at the central longitudinal axis of the distal section 220*a*. The concave surfaces 312, 314 allow the shell 36*a* to be pivoted relative to the main body 38*a* of the distal section 220*a*. For example, FIGS. 18 and 19 show the shell 36*a* in a straight position, and FIGS. 20 and 21 shows the shell 36*a* with the nose of the shell angled downwardly. It will be appreciated that the concave surfaces 312, 314 allow the nose of the shell 36*a* to be pivoted upwardly relative to the main body 38*a*, downwardly relative to the main body 38*a*, leftwardly relative to the main body 38*a* and rightwardly relative to the main body 38*a*. The shell 38*a* can also be angled at any intermediate position between upward, downward, leftward and rightward angle positions.

Figure 22:
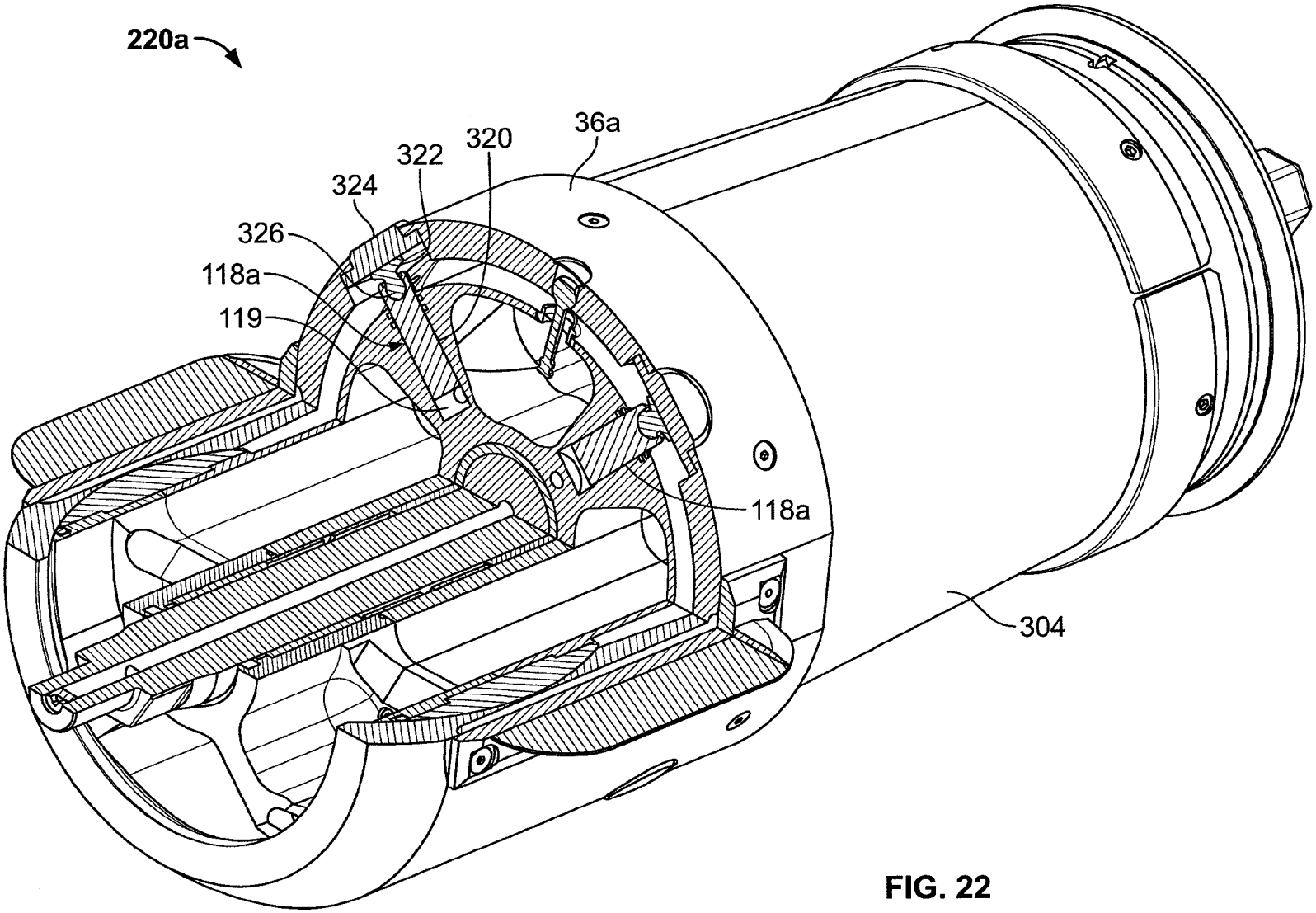
FIG. 22 is a perspective, cross-sectional view of a distal end of the distal drill head section of FIG. 13.

The distal section 220*a* also includes a drive mechanism for providing the motive force for pivoting the shell 36*a* and the main body 38*a* relative to one another at the pivot structure 310. For example, as shown at FIGS. 19, 21 and 22, the drive structure includes a plurality of pistons 118*a* mounted in cylinders 119 defined by a module of the main body 38*a*. The pistons 118*a* include four radial pistons that are offset from one another by 90°. The pivot structure 310 is positioned adjacent the distal end 300 of the shell 36*a*, and module defining the cylinders 119 is proximately offset from the pivot structure 310. In one embodiment, the pistons 118*a* are located at the proximal end 302 of the shell 36*a*. The pistons 118*a* can be selectively extended and retracted to move the proximal end 302 of the shell 36*a* such that the shell 36*a* pivots about the pivot structure 310. To pivot the nose of the shell 36*a* downwardly, the two upper pistons 118*a* are extended while the two lower pistons 118*a* are retracted. To pivot the nose of the shell 36*a* upwardly, the two upper pistons 118*a* are retracted and the two lower pistons 118*a* are extended. To pivot the nose of the shell 36*a* leftwardly, the two rightward pistons 118*a* are extended and the two leftward pistons 118*a* are retracted. To pivot the nose of the shell 36*a* rightwardly, the two leftward pistons 118*a* are extended and the two rightward pistons 118*a* are retracted.

To better accommodate the pivotal movement of the shell 36*a*, the pistons 118*a* have a multi-piece configuration including a main piston body 320 and an outer foot 322. The feet 322 have planar outer surfaces that engage pads 324 of the shell 36*a*. The interface between the pads 324 and the feet 322 is planar. Joints such as universal joints 326 are provided between the feet 322 and the main bodies 320 of the pistons 118*a*.

Figure 23:
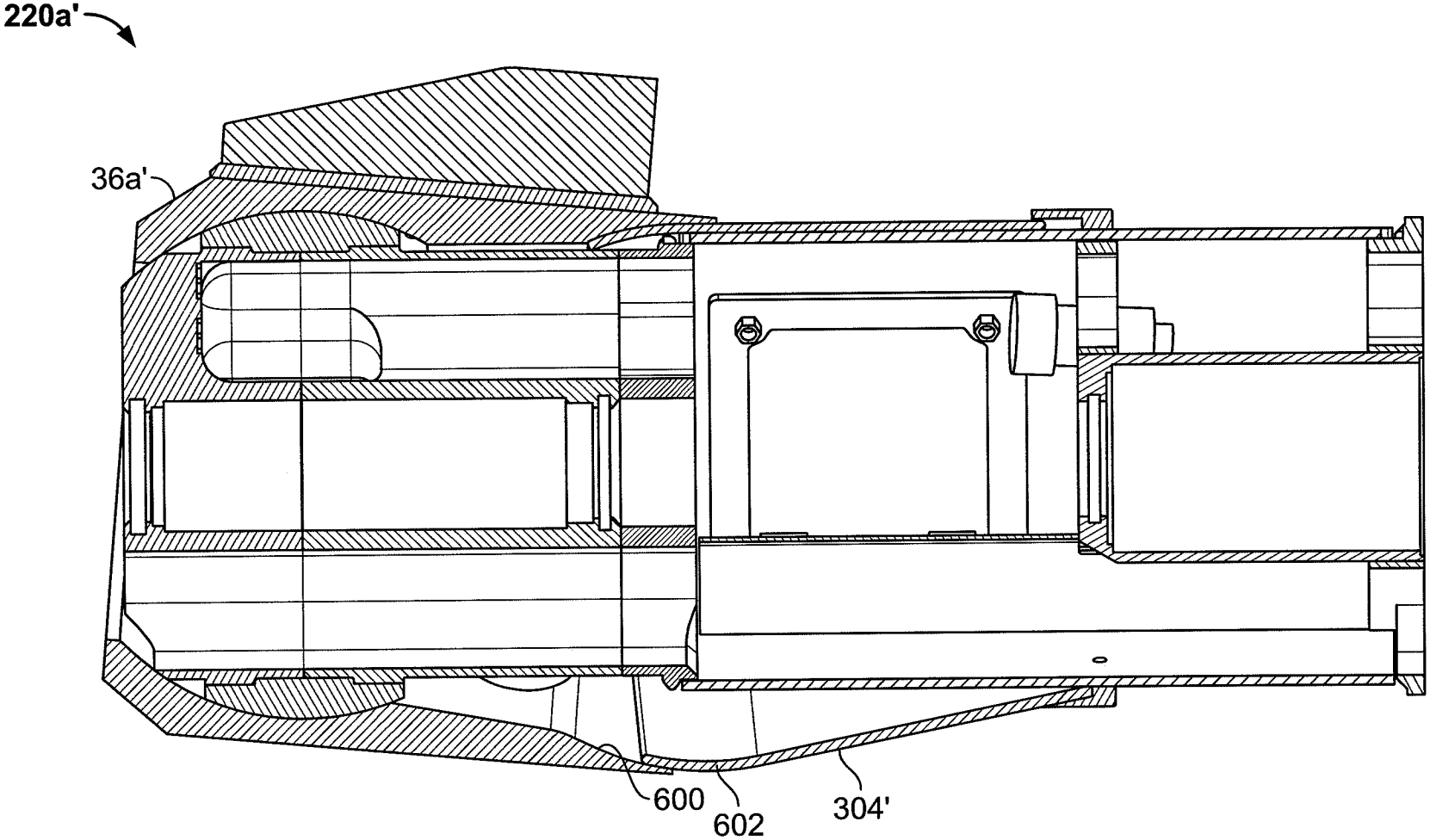
FIG. 23 is a side, cross-sectional view of another alternative distal drill head section taken along a vertical plane that longitudinally bisects the drill head.

FIG. 23 shows an alternative distal section 220*a*' having the same configuration that the distal section 220*a* except an additional universal pivot structure has been added. For example, referring to FIG. 23, the distal section 220*a*' includes a shell 36*a*' having a proximal end having a concave spherical surface 600 that interfaces with a corresponding convex spherical surface 602 of a skirt 304' of the distal section 220*a*'. The spherical surfaces 600, 602 better allow the steering shell 36*a*' to pivot relative to the skirt 304' as the steering shell 36*a*' pivots about the front pivot structure.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

The invention claimed is:

1. A tunneling apparatus comprising:

a drill head including a main body having a distal end and an oppositely disposed proximal end;

a steering shell disposed at the distal end of the drill head and being movable relative to the main body of the drill head, the steering shell being pivotally movable relative to the main body of the drill head; and a universal joint disposed between the steering shell and the main body of the drill head for allowing the steering shell to be pivoted relative to the main body of the drill head, wherein the drill head includes a plurality of pistons mounted in a plurality of piston cylinders for altering the relative position between the steering shell and the main body of the drill head, and wherein the pistons have multi-piece configurations including main piston bodies and outer feet, the pistons having pivoting joints provided between the main piston bodies and outer feet.

2. The tunneling apparatus of claim 1, wherein the drill head includes:

a drill stem having a distal end providing a bit mounting location, the drill stem being rotatably mounted in the main body by bearings that allow the drill stem to rotate relative to the main body; and a series of cylinders that generate relative movement between the main body and the steering shell at the universal joint.

3. The tunneling apparatus of claim 2, wherein the steering shell is located behind the drill bit mounting location and includes a cylindrical portion positioned around the main body of the drill head.

4. The tunneling apparatus of claim 2, wherein the universal joint is located at a distal end of the steering shell and the cylinders are located at a proximal half of the steering shell.

5. The tunneling apparatus of claim 1, wherein the universal joint is formed by a concave surface provided on an inside of the steering shell that opposes and engages a corresponding convex surface provided on the main body of the drill head.

6. The tunneling apparatus of claim 5, wherein both the concave and convex surfaces form annular spherical shapes having centers at a central longitudinal axis of a distal section of the steering shell.

7. The tunneling apparatus of claim 1, further comprising a drive mechanism for pivoting the steering shell about the universal joint relative to the main body of the drill head, the drive mechanism being proximally offset from the universal joint.

8. The tunneling apparatus of claim 1, wherein the steering shell includes a body having an outer surface and a plurality of stabilizing extensions disposed on the outer surface.

9. The tunneling apparatus of claim 8, wherein the stabilizing extensions are wings having a leading end and a tail end, the wings extending farther outwardly in a radial direction than the cutter unit of the drill head.

10. The tunneling apparatus of claim 9, wherein the angle of the wings with respect to a central longitudinal axis of the drill head can be changed by pivoting the steering shell.

11. The tunneling apparatus of claim 8, wherein the stabilizing extensions are selectively extendable and retractable.

12. The tunneling apparatus of claim 1, wherein the steering shell includes a body having an outer surface and a plurality of mounting pads to which stabilizing structures may be attached.

13. The tunneling apparatus of claim 1, wherein the steering shell includes contact pads having inner contact surfaces that engage outer ends of the piston cylinders.

14. The tunneling apparatus of claim 1, wherein the steering shell includes a flexible skirt that extends from the steering shell to the main body to prevent contaminants from entering the steering shell.

15. The tunneling apparatus of claim 14, wherein the flexible skirt is secured to the steering shell with an inner collar.

16. The tunneling apparatus of claim 14, wherein the flexible skirt is secured to the main body with an outer collar.

17. The tunneling apparatus of claim 1, wherein a proximal end of the steering shell includes a concave spherical surface that interfaces with a corresponding convex spherical surface of a skirt to better allow the steering shell to pivot relative to the skirt as the steering shell pivots about the universal joint.

18. A tunneling apparatus comprising:

a drill head including a main body having a distal end and an oppositely disposed proximal end;

a steering shell disposed at the distal end of the drill head and being movable relative to the main body of the drill head, the steering shell including a body having an outer surface and a plurality of wings attached in a fixed position on the outer surface, wherein the wings are selectively extendable to at least a second fixed position.

19. The tunneling apparatus of claim 18, wherein the wings have one fixed position.

20. A tunneling apparatus comprising:

a drill head including a main body and a cutter unit and defining a central longitudinal axis, the main body having a distal end and an oppositely disposed proximal end, the cutter unit being disposed on the distal end of the main body and adapted to rotate about the central longitudinal axis;

a steering shell disposed at the distal end of the drill head and being movable relative to the main body of the drill head, the steering shell including a body having an outer surface and a plurality of wings attached in a fixed position on the outer surface, each of the wings having a leading end and a tail end, the wings extending farther outwardly in a radial direction than the cutter unit of the drill head, wherein the wings are selectively extendable to at least a second fixed position.

21. The tunneling apparatus of claim 20, wherein the wings have one fixed position.

22. A tunneling apparatus comprising:

a drill head including a main body having a distal end and an oppositely disposed proximal end;

a steering shell disposed at the distal end of the drill head and being movable relative to the main body of the drill head; and stabilization wings attached in a fixed position on the drill head, wherein the wings are selectively extendable to at least a second fixed position.

23. The tunneling apparatus of claim 22, wherein the wings have one fixed position.

* * * * *